US007779600B1

(12) United States Patent
Saebi

(10) Patent No.: US 7,779,600 B1
(45) Date of Patent: Aug. 24, 2010

(54) METHOD OF CONSTRUCTING A COMPOSITE ROOF

(76) Inventor: Nasser Saebi, 18231 N. 66th La., Glendale, AZ (US) 85308

( * ) Notice: Subject to any disclaimer, the term of this patent is extended or adjusted under 35 U.S.C. 154(b) by 147 days.

(21) Appl. No.: 11/329,822

(22) Filed: Jan. 10, 2006

Related U.S. Application Data

(63) Continuation-in-part of application No. 10/897,657, filed on Jul. 21, 2004, now abandoned, which is a continuation of application No. 10/823,838, filed on Apr. 13, 2004, now Pat. No. 6,985,832, which is a continuation of application No. 10/132,915, filed on Apr. 26, 2002, now Pat. No. 6,721,684.

(60) Provisional application No. 60/287,240, filed on Apr. 26, 2001, provisional application No. 60/340,974, filed on Nov. 29, 2001.

(51) Int. Cl.
*E04B 1/14* (2006.01)

(52) U.S. Cl. ..... 52/745.19; 52/79.1; 52/79.9; 52/90.1; 52/309.1; 52/309.14

(58) Field of Classification Search ..... 52/745.06, 52/745.2, 79.11, 223.8, 650.1, 90.2, 309.2, 52/309.5, 309.6, 309.14, 309.15, 79.1, 79.2, 52/92.3, 122.1, 123, 123.1, 223.11, 223.9, 52/272, 309.1, 309.3, 309.4, 309.7, 309.8, 52/309.9, 309.11, 309.12, 309.13, 309.16, 52/309.17, 408, 410, 455, 456, 633, 648.1, 52/649.1, 649.2, 656.1, 656.2, 656.3, 723.8; 703/1, 6, 7; 715/961, 964; 264/1.1, 2.5, 264/5, 31, 34, 35, 219, 228, 229, 239, 241, 264/250, 251, 253, 257, 603, 640, 641, 642, 264/643; 345/418, 419, 420; 428/68, 71, 428/98, 141, 142, 143, 144, 147, 221, 304.4, 428/318.4, 319.3, 319.7, 319.9, 323, 325, 428/326, 327; 700/90, 95, 97
See application file for complete search history.

(56) References Cited

U.S. PATENT DOCUMENTS

| | | | | | |
|---|---|---|---|---|---|
| 2,948,995 | A | * | 8/1960 | Cogan | 52/259 |
| 3,377,755 | A | * | 4/1968 | Meuli et al. | 52/79.13 |
| 3,405,903 | A | * | 10/1968 | Sullivan | 249/28 |
| 3,410,044 | A | * | 11/1968 | Moog | 52/309.12 |
| 3,435,580 | A | * | 4/1969 | Johnson et al. | 52/405.3 |
| 3,443,347 | A | * | 5/1969 | Varnell et al. | 52/223.3 |
| 3,510,997 | A | * | 5/1970 | Ratych | 52/79.2 |
| 3,793,975 | A | * | 2/1974 | Duff | 114/65 A |
| 3,861,093 | A | * | 1/1975 | Robinson | 52/79.14 |
| 3,932,969 | A | * | 1/1976 | Matras | 52/86 |
| 4,077,177 | A | * | 3/1978 | Boothroyd et al. | 52/745.07 |
| 4,453,359 | A | * | 6/1984 | Robinson | 52/389 |
| 4,532,745 | A | * | 8/1985 | Kinard | 52/251 |
| 4,774,794 | A | * | 10/1988 | Grieb | 52/309.7 |
| 4,823,534 | A | * | 4/1989 | Hebinck | 52/742.14 |
| 5,354,414 | A | * | 10/1994 | Feygin | 216/34 |
| 5,419,200 | A | * | 5/1995 | Burns et al. | 73/760 |
| 5,514,232 | A | * | 5/1996 | Burns | 156/64 |
| 5,637,175 | A | * | 6/1997 | Feygin et al. | 156/264 |
| 5,640,812 | A | * | 6/1997 | Crowley et al. | 52/90.1 |
| 5,684,713 | A | * | 11/1997 | Asada et al. | 716/19 |
| 5,697,189 | A | * | 12/1997 | Miller et al. | 52/79.9 |
| 5,771,649 | A | * | 6/1998 | Zweig | 52/405.1 |
| 5,876,550 | A | * | 3/1999 | Feygin et al. | 156/264 |

(Continued)

*Primary Examiner*—Edward R Cosimano
(74) *Attorney, Agent, or Firm*—Albert W. Davis, Jr.

(57) ABSTRACT

The invention provides a method of constructing a building roof made from Expanded PolyStyrene (EPS) which is coated on the inside and outside with Glass Fiber Reinforced Concrete (GFRC). The building roof is designed in a CAD program. The roof is then constructed of beams, such as I-shaped beams, of foam and GFRC.

8 Claims, 54 Drawing Sheets

U.S. PATENT DOCUMENTS 5,921,046 A * 7/1999 Hammond, Jr. ..... 52/564
5,956,500 A * 9/1999 Shimmell ..... 703/7
6,006,480 A * 12/1999 Rook ..... 52/309.12
6,145,270 A * 11/2000 Hillman ..... 52/834
6,164,034 A * 12/2000 Roetheli et al. ..... 52/560
6,182,409 B1 * 2/2001 Visser ..... 52/309.13
6,182,891 B1 * 2/2001 Furuhashi et al. ..... 235/379
6,205,728 B1 * 3/2001 Sutelan ..... 52/309.7
6,305,142 B1 * 10/2001 Brisson et al. ..... 52/742.14
6,308,490 B1 * 10/2001 Saebi ..... 52/745.07
6,460,301 B1 * 10/2002 McKee ..... 52/235
6,460,302 B1 * 10/2002 Neuhaus et al. ..... 52/261
6,912,488 B1 * 6/2005 Saebi ..... 703/1
6,985,832 B2 * 1/2006 Saebi ..... 702/189
6,985,932 B1 * 1/2006 Glaser et al. ..... 709/219
2003/0079438 A1 * 5/2003 Stephens et al. ..... 52/782.1
2004/0204903 A1 * 10/2004 Saebi ..... 702/167

* cited by examiner

SLICED FRAMES GROUND CONNECTION DETAIL

SCALE: NONE

METHOD OF CONSTRUCTING A COMPOSITE ROOF

CROSS-REFERENCE TO RELATED APPLICATIONS

This application is a continuation-in-part of Ser. No. 10/823,838 filed Apr. 13, 2004, now U.S. Pat. No. 6,985,832 granted Jan. 10, 2006 which is a continuation of Ser. No. 10/132,915 filed Apr. 26, 2002, now U.S. Pat. No. 6,721,684 granted Apr. 13, 2004 which claims the benefit of expired provisional patent application Ser. No. 60/287,240 filed Apr. 26, 2001 and expired provisional patent application Ser. No. 60/340,974 filed Nov. 29, 2001 and this application is a continuation-in-part of abandoned patent application Ser. No. 10/897,657 filed Jul. 21, 2004. This application is related to U.S. patent application Ser. No. 09/563,142 filed May 2, 2000, now U.S. Pat. No. 6,308,490 granted Oct. 30, 2001 and Ser. No. 09/563,241 filed May 1, 2000, now U.S. Pat. No. 6,912,488 granted Jun. 28, 2005.

In as far as possible, the disclosures of all of these applications are incorporated by reference in this application.

BACKGROUND OF THE INVENTION

The idea of a building formed of a composite of foam coated with concrete or cement started over fifty years ago. The fact that such buildings are not in wide use is not because they are inferior structures to houses built from wood. Their scarcity is due to the fact that any new way of manufacturing buildings confronts the problem of proving to the various government organizations that such a house or building can meet the code requirements. This proof is not easily or inexpensively done. Further, each different design of house would be required to have a similar proof to be acceptable.

Many of the designs for foam-concrete composite buildings have not been cost effective. Other designs have not been able to span very large distances thereby severely limiting the size of their rooms.

These problems and others have been caused by the inability of the designers to analyze the strength of the composite buildings. Most conventional buildings, which have three components (structural framing, interior sheathing and exterior sheathing), fit into a simple mathematical format and can be analyzed by classical mathematical methods. Buildings using composite construction materials are complex to analyze and can not be solved classically.

BRIEF SUMMARY OF THE INVENTION

The invention discloses structural designs discovered by the analysis to be of great strength and low mass.

Since the strength of these buildings can now be analyzed, the following objects can now be provided:

It is an object of the invention to provide low cost housing with an acceptable appearance.

It is an object to provide a method of manufacture requiring less skill in the work force.

It is another object of the invention to produce hoses that use easily assembled materials.

It is an object of the invention to provide a building that has a high insulation value to lower the energy consumption of the house.

It is a further object to provide a building that is better able to withstand the forces of an earthquake, and other forces of nature at an affordable price.

DETAILED DESCRIPTION OF THE INVENTION

Figure 1:
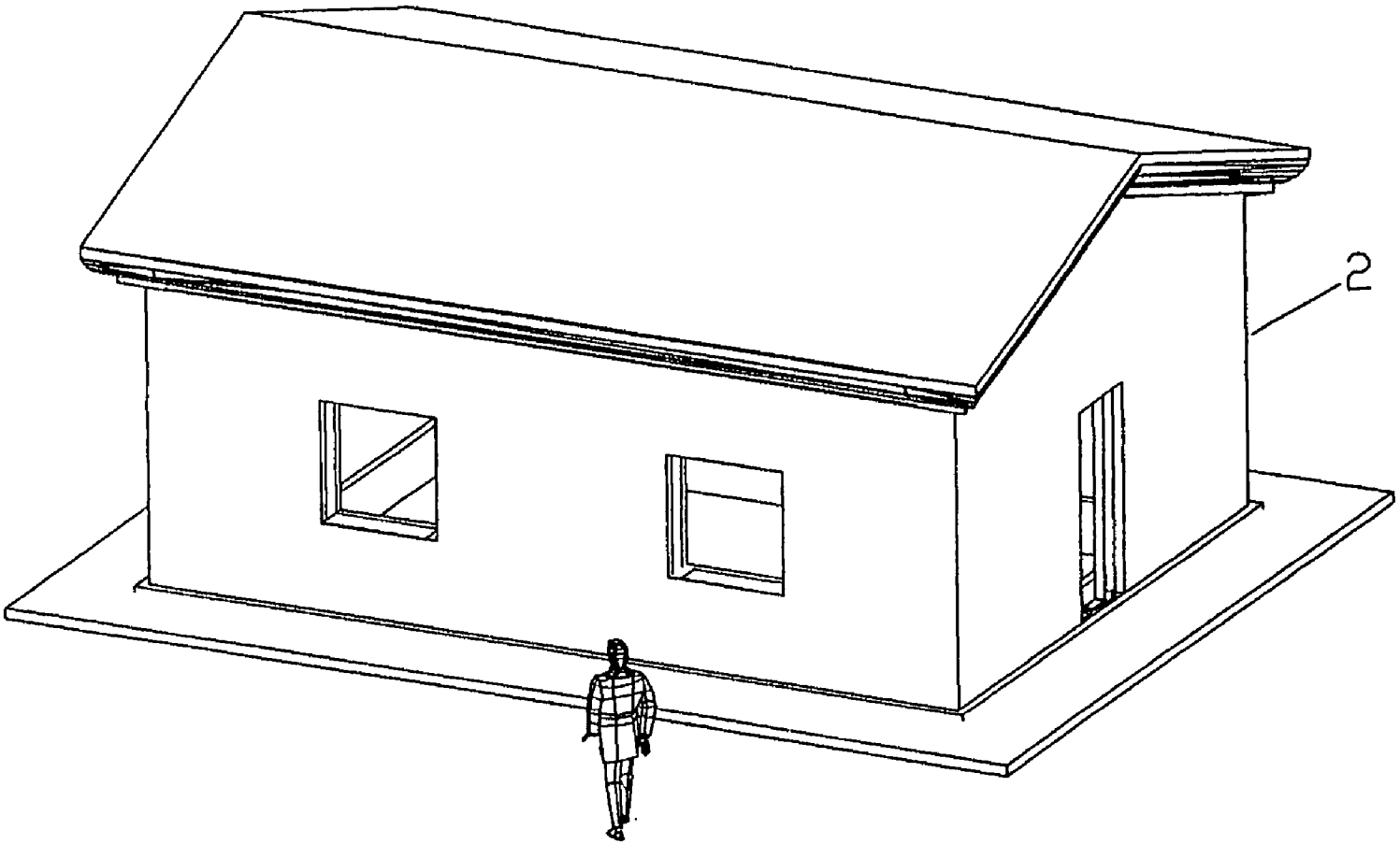
FIG. 1 is a perspective view of one embodiment of the inventive building.

The manufacture or construction of the inventive building starts with the creation of a 3-Dimensional; "solid" model of the building in a computer assisted drafting (CAD) program in a computer. Suitable CAD programs are AutoCAD™, ProE™, Solid Works™, Inventor™, etc. The building is then sliced in parallel, usually vertical planes. These planes can correspond to various thicknesses of the slices, preferably of a size to be manhandled.

These slices of the building are then created by using foam, such as, expanded polystyrene (EPS). The foam elements that make up a slice can be cut from commercially available sizes of foam, such as slabs of 1 to 36 inches thick and 4 feet wide×8 feet long or 8 feet wide×8 feet long. The cutting can be performed by hand, machine or computer assisted manufacturing (CAM) program and a computer driven machine. The foam can be cut by hot wire or other suitable cutting process. The slice can be made by cutting elements which are then glued or otherwise joined together to form the slice.

The slices are then joined by adhesive to other slices to form the foam core of the building walls. It may be necessary to spray/coat at least a portion of the slice with a material that will increase the strength of the slice to allow the slice to be moved without breaking. In this case, some or all of the non-abutting surfaces of the sides of the slice can be coated with a strengthening coat, such as glass fiber reinforced concrete (GFRC).

When multiple slices are joined, they become heavy. Therefore, it may be desirable to place the slice or slices in their final position on concrete footings before they become too heavy to move easily. The footing can be a standard footing. The foam pieces are adhered to the footing by using a layer of concrete to join the foam to the footing while also leveling the foam. The walls of the home are assembled by gluing cut foam pieces together.

The slices or sections are coated with adhesive on the abutting sides before being placed into position and joined to the previously positioned slice or section. A suitable adhesive would be either 3M™ FASTBOND™ Contact adhesive 30-NF or 2000-NF. The adhesive can be sprayed, rolled or applied to walls in any other way. The foam building or portions thereof can be sprayed with a coating to increase the stability of the building when desired. That is, after a few slices are in position and joined, a coating of glass fiber reinforced concrete (GFRC) can be added to the exposed surfaces of the joined slices. Alternatively, the coating can be added when the foam structure is fully in place.

The GFRC coating can be sprayed on the foam or applied in other ways. It can be reworked until it sets. A coating of 3/16 inches thickness is usually adequate; however, a coating of varying thickness may be desirable. A suitable range for the coating can be 2/16 to 8/16 inches. More information concerning the GFRC coating and spray equipment can be obtained from the PRECAST/PRESTRESSED CONCRETE INSTITUTE OF Chicago, Ill. As an example of the proportions, the coating would be made by mixing 3-5% Cem-FIL™ fibers (glass fibers) from the VEROTEX COMPANY into a 1:1, cement: sand and water matrix and other additives.

FIG. 1 shows a perspective view of the habitable building 2 of the invention as it would be before windows and doors are installed.

Figure 2:
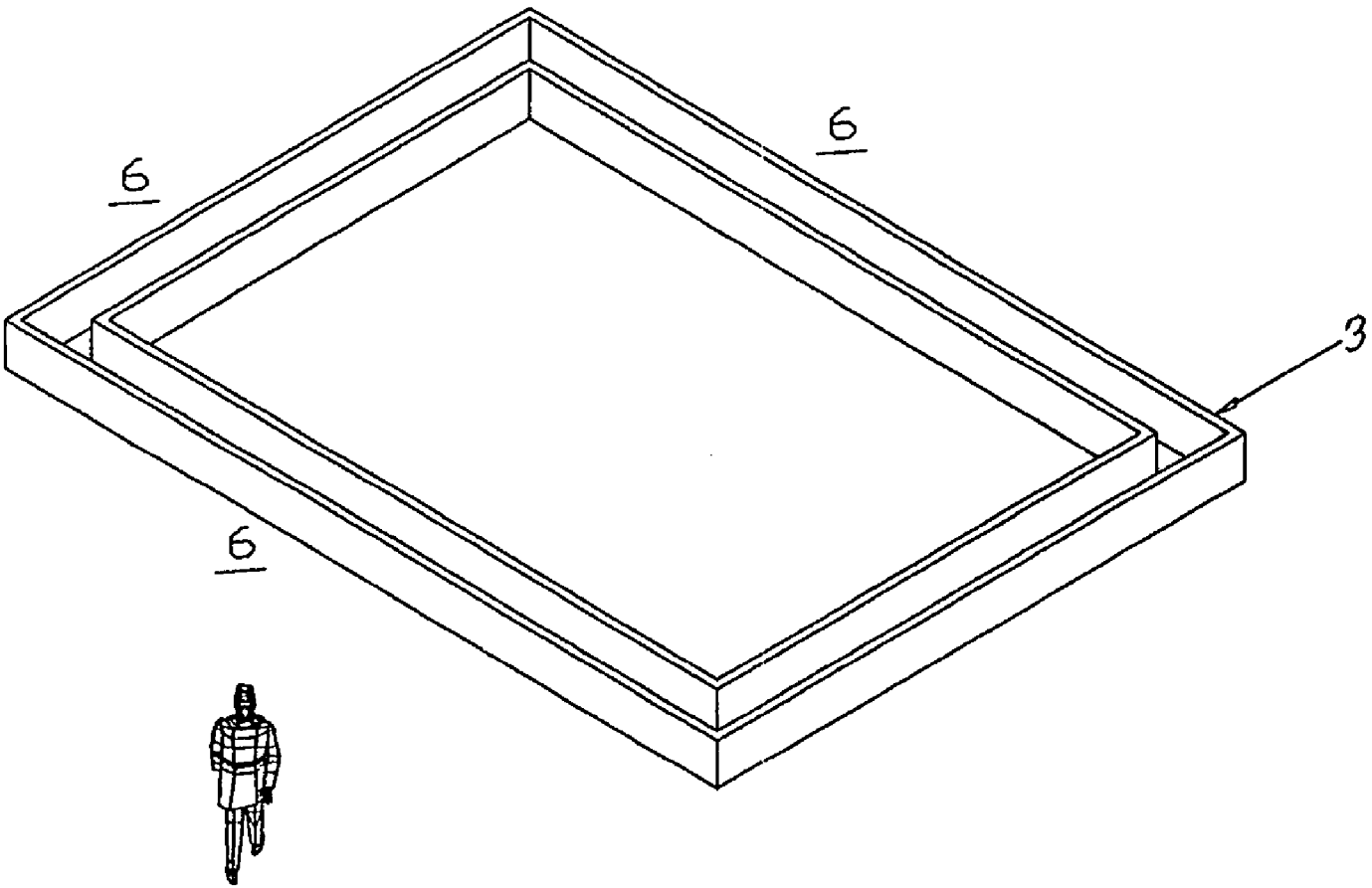
FIG. 2 is a perspective view of the footings.

FIG. 2 shows a perspective view of the concrete foundation or footing 3 for the walls of the building.

Figure 3:
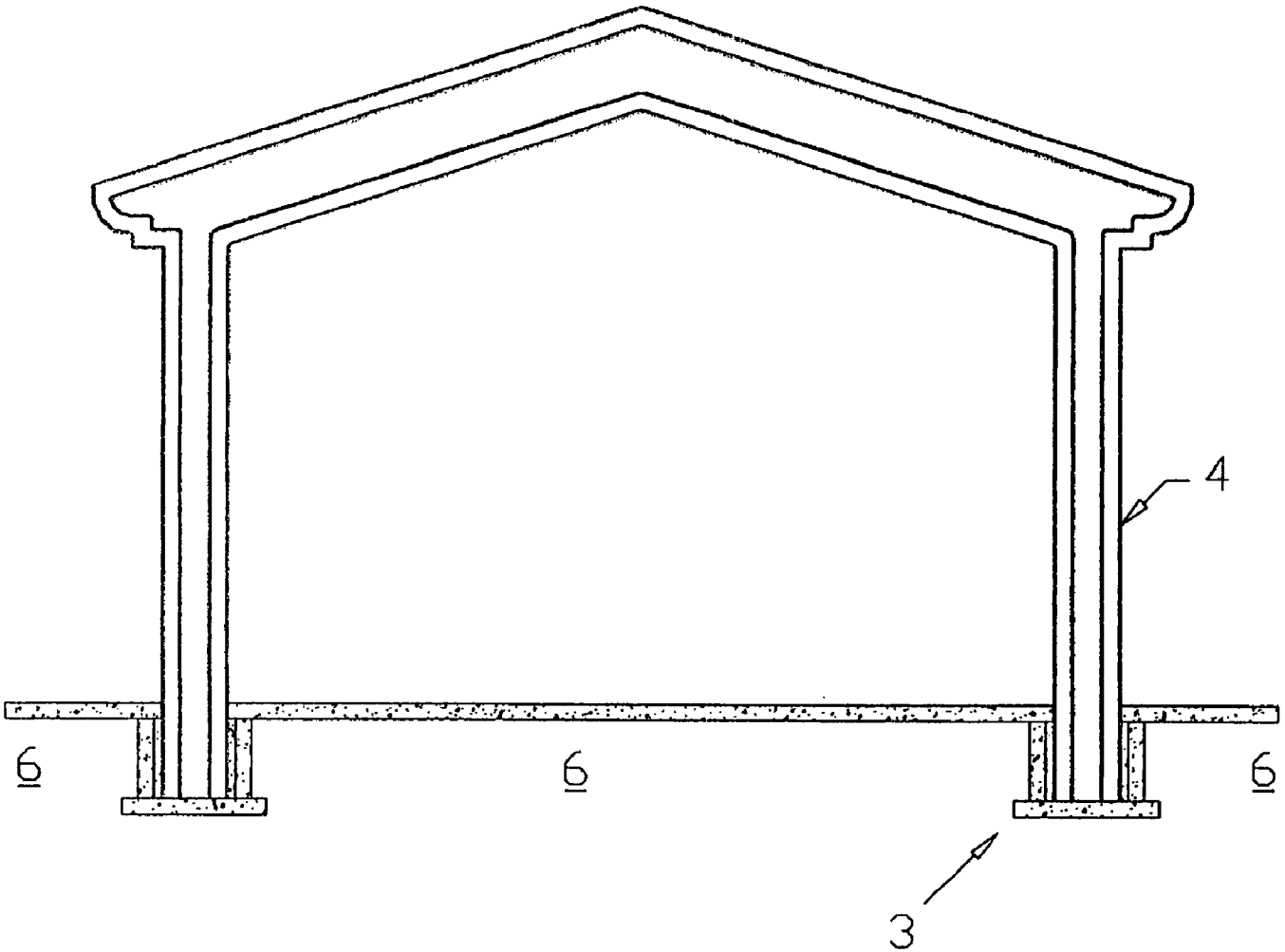
FIG. 3 is a side view of a slice or portion of the building.

FIG. 3 shows a slice 4 of the building positioned on the concrete foundation 3. The slice 4 is made from pieces of foam 5 which are cut from larger foam as described previously. The pieces of foam 5 are shown in FIGS. 4-7. In FIG. 3, the foam pieces 5 have been coated with GFRC (Glass Fiber Reinforced Concrete) 7 after they were joined by adhesives. The slice 4 is coated with GFRC 7 to add strength to the slice. The GFRC coating 7 is a formulation of cement/concrete, glass fibers and other ingredients. Thus, it is also a reinforced cement coating. The slice 4 can be made in a factory and shipped to the building site; it can be made at the site from pieces shipped there; it can be initially coated after being positioned on the foundation, or it can be partially made in a factory and finished at the building site. The footing 3 is created by digging a trench and creating a level concrete surface in the trench. Using forms, sidewalls can be added to the footing. The slice 4 is adhered to the bottom of the footing by using grout or concrete. The grout can help level the slice. Where sidewalls are added to the footing, grout is also added between the footing sidewalls and the slice.

Figure 4:
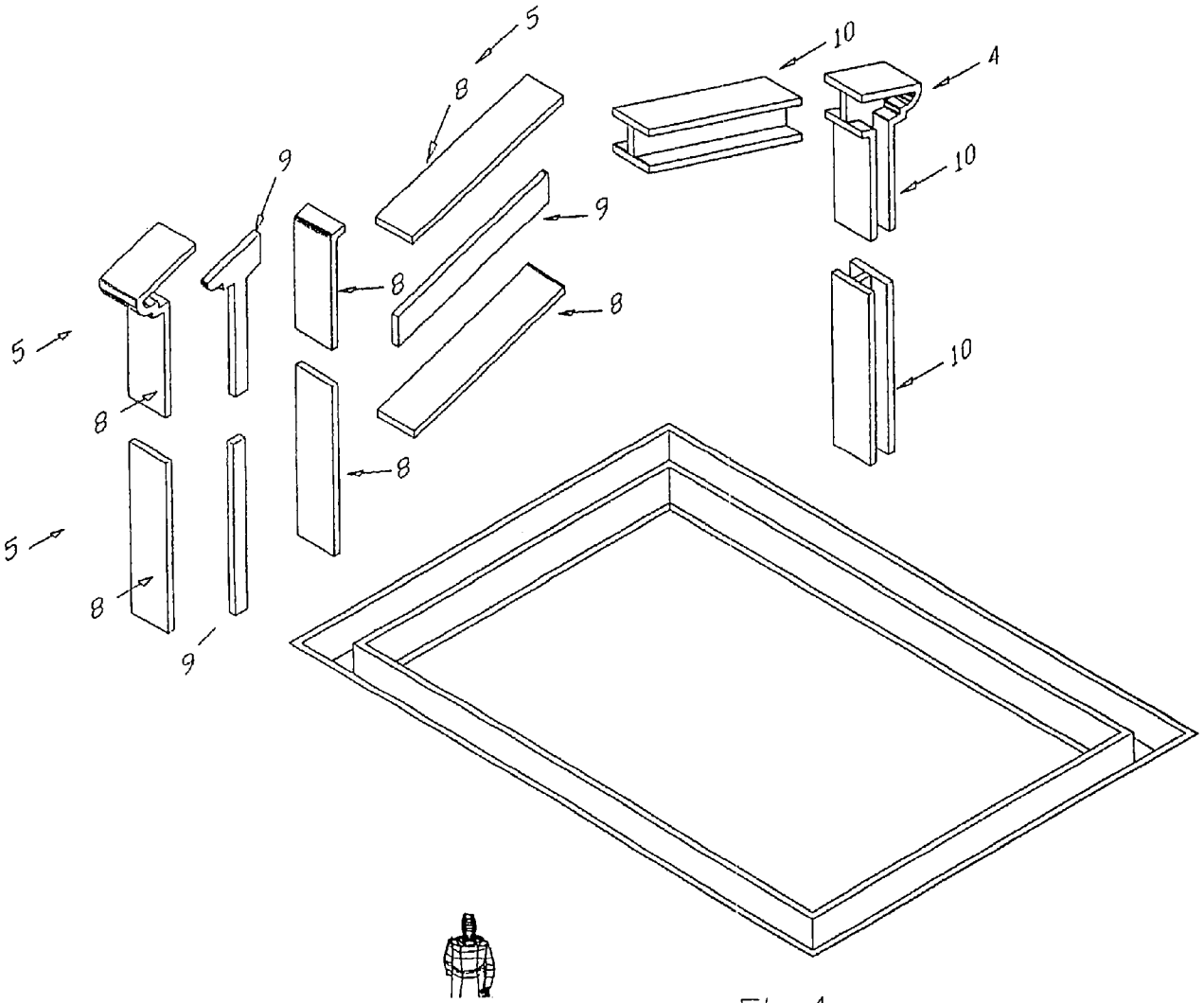
FIG. 4 is an exploded perspective view of the slice of FIG. 3.

FIG. 4 shows the pieces of foam 5 that make up the slice 4 in an exploded arrangement. The slice 4 can be any size in width. A 2-foot width would be acceptable. A thin section makes the weight of the slice more easily handled. The slice 4 is formed as an I-beam 10 in cross-section. The I-beam is formed by flanges 8 and web 9. The figure shows the pieces partially assembled on the right side. The slice 4 is made exceptionally strong by the use of an I-beam configuration. The foam pieces 5 are joined together by the use of adhesives previously disclosed. The I-beam is formed by web 9 and flanges 8.

Figure 5:
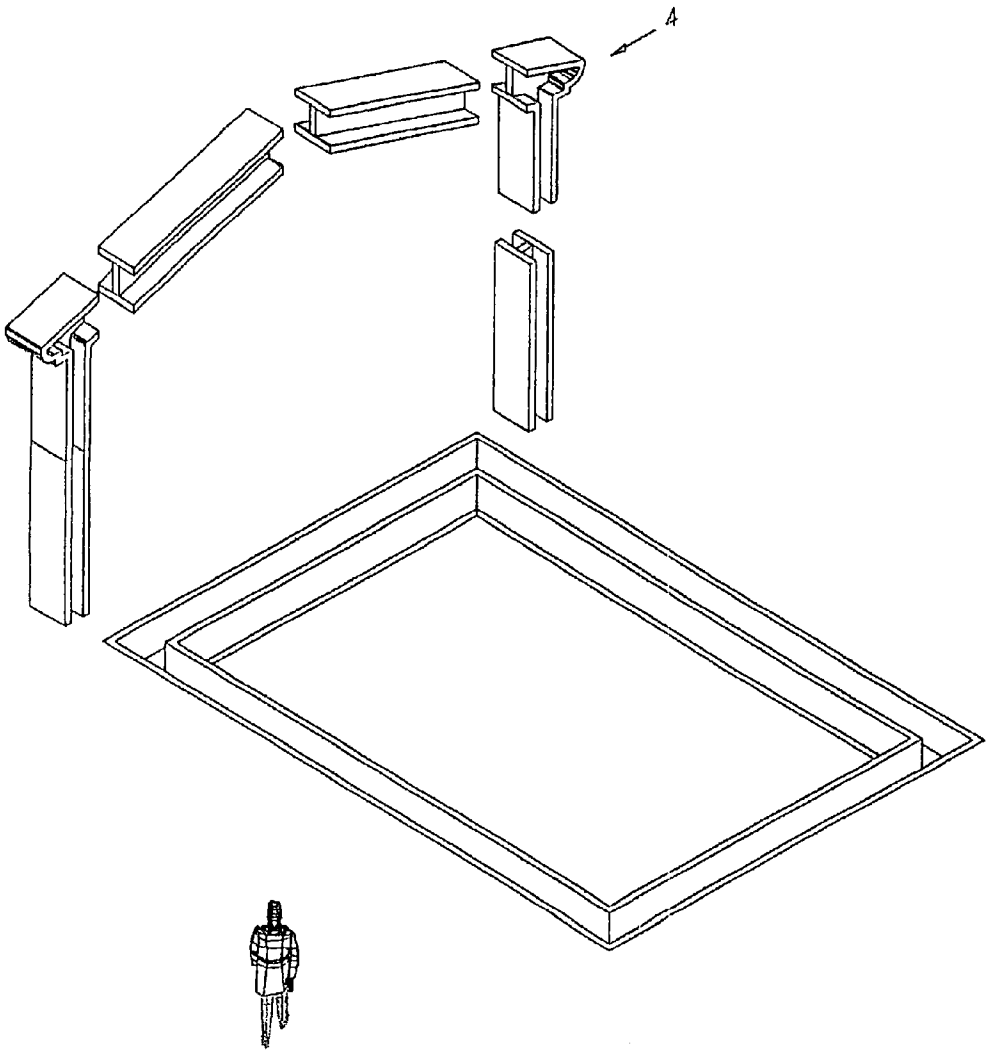
FIGS. 5, 6 and 7 show the progressive assembly of the slice 4 of FIG. 4.
Figure 6:
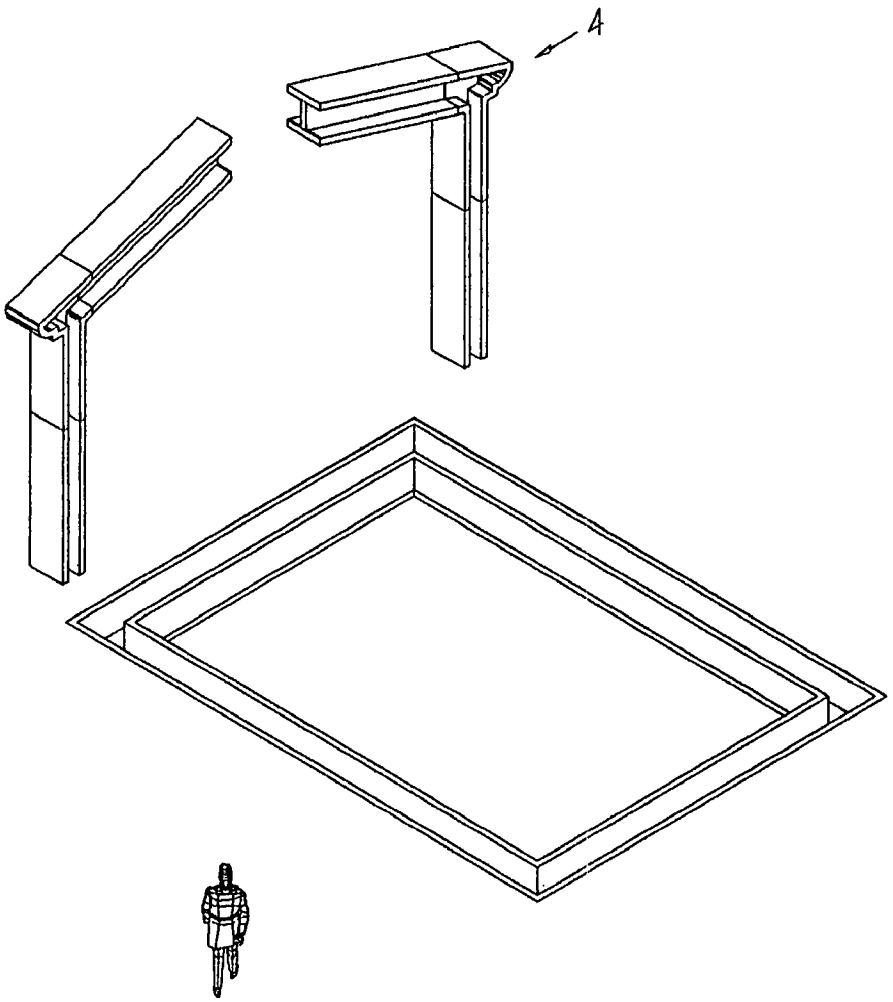
Figure 7:
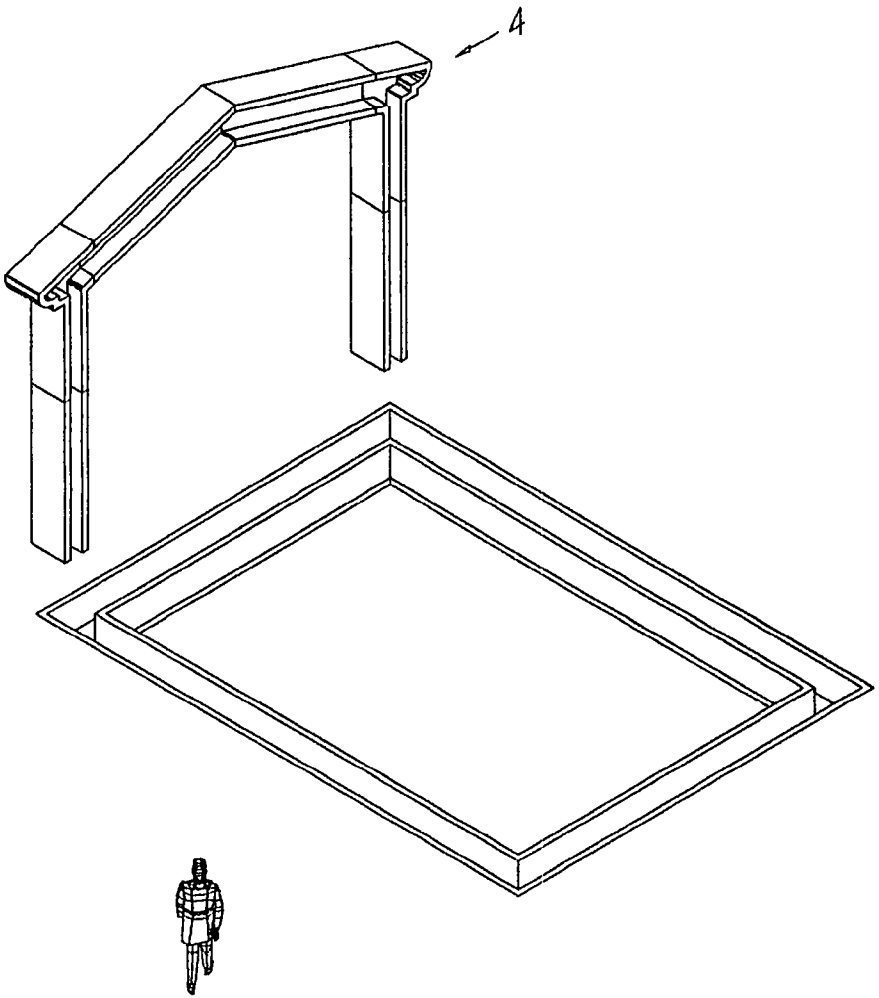

FIGS. 5, 6 and 7 show the progressive assembly of the slice 4 of FIG. 4.

Figure 8:
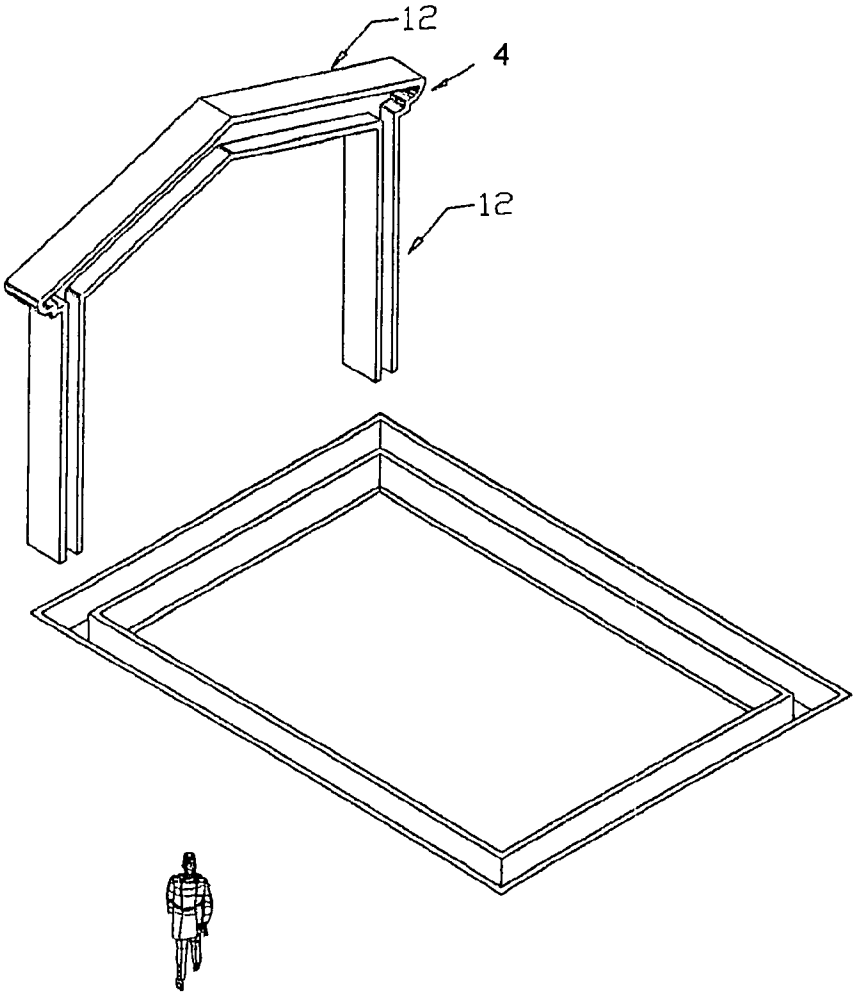
FIG. 8 is a perspective view of the slice coated with GFRC.

FIG. 8 shows the slice 4 fully coated with GFRC except on the surfaces abutting surfaces on the adjacent slice which may receive adhesives. The coated slice is ready to be positioned on the footing. The slice can be joined to the footing by adhesives previously disclosed or by grout/cement. The slice 4 can also be placed on the footings before having any of its surfaces coated.

Figure 9:
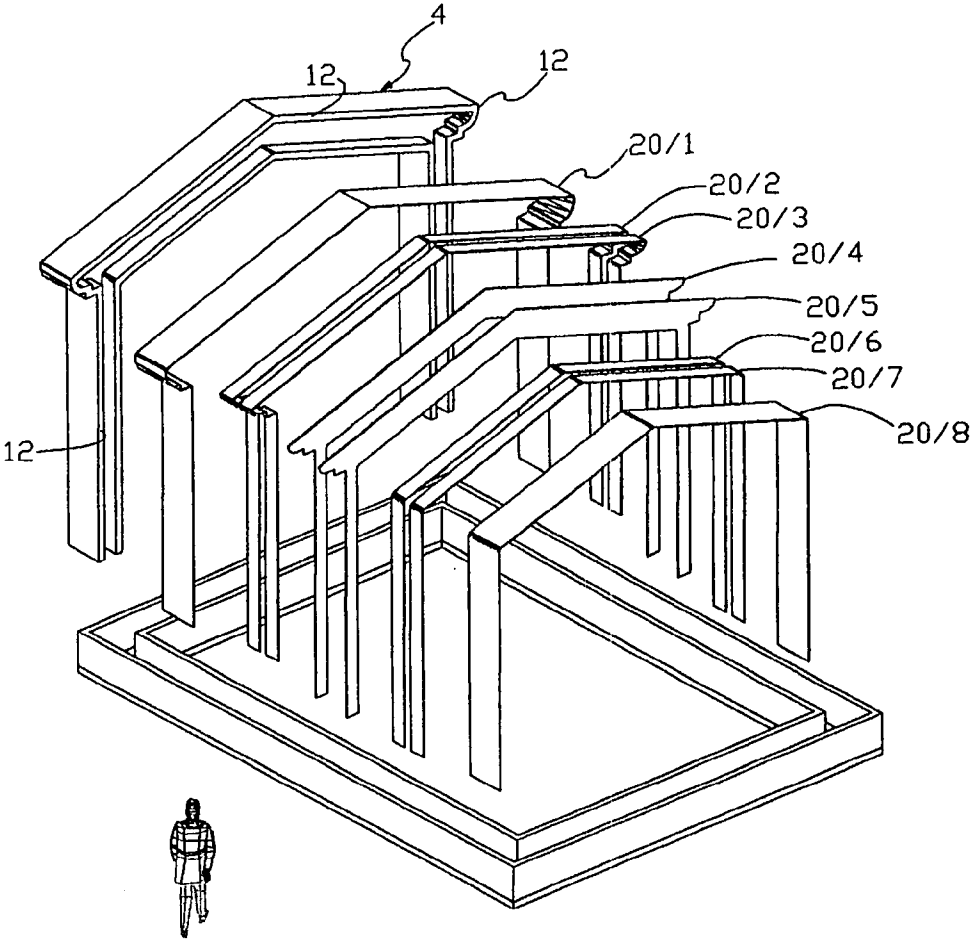
FIG. 9 is an exploded perspective view of the slice and its coating layers.

FIG. 9 shows the GFRC coated slice 4 and the various side coatings 20/1-20/8 removed and exploded to show the surface coatings individually. It is preferred to provide this preliminary coat 20/1-20/8 to all of the surfaces of the slice 4 except for the abutting edges 12 of the adjoining slices. The slice can be coated at a factory or at the building site. Preferable, the slice pieces are formed or cut, then joined and coated in the factory. Not all of the surfaces need to be coated. The preliminary coating is used to make the slice strong enough to withstand the stress experienced during transport to the building site, movement from the truck to the foundation/footing and wind loads prior to adding the final coat.

The side coatings of GFRC of the upper flange are 20/1-20/3. the web coatings are 20/4, 20/5. The coatings of the lower flange are 20/6-20/8.

Any or many of the coatings 20/1-20/8 can be omitted. Preferably, at least one surface is coated. That is only one of the coatings 20/1-20/8 may be needed to provide sufficient strength until the final coating of GFRC. In the proper circumstances, all of the coatings 20/1-20/8 can be omitted until the inner or outer coatings of GFRC.

Figure 10:
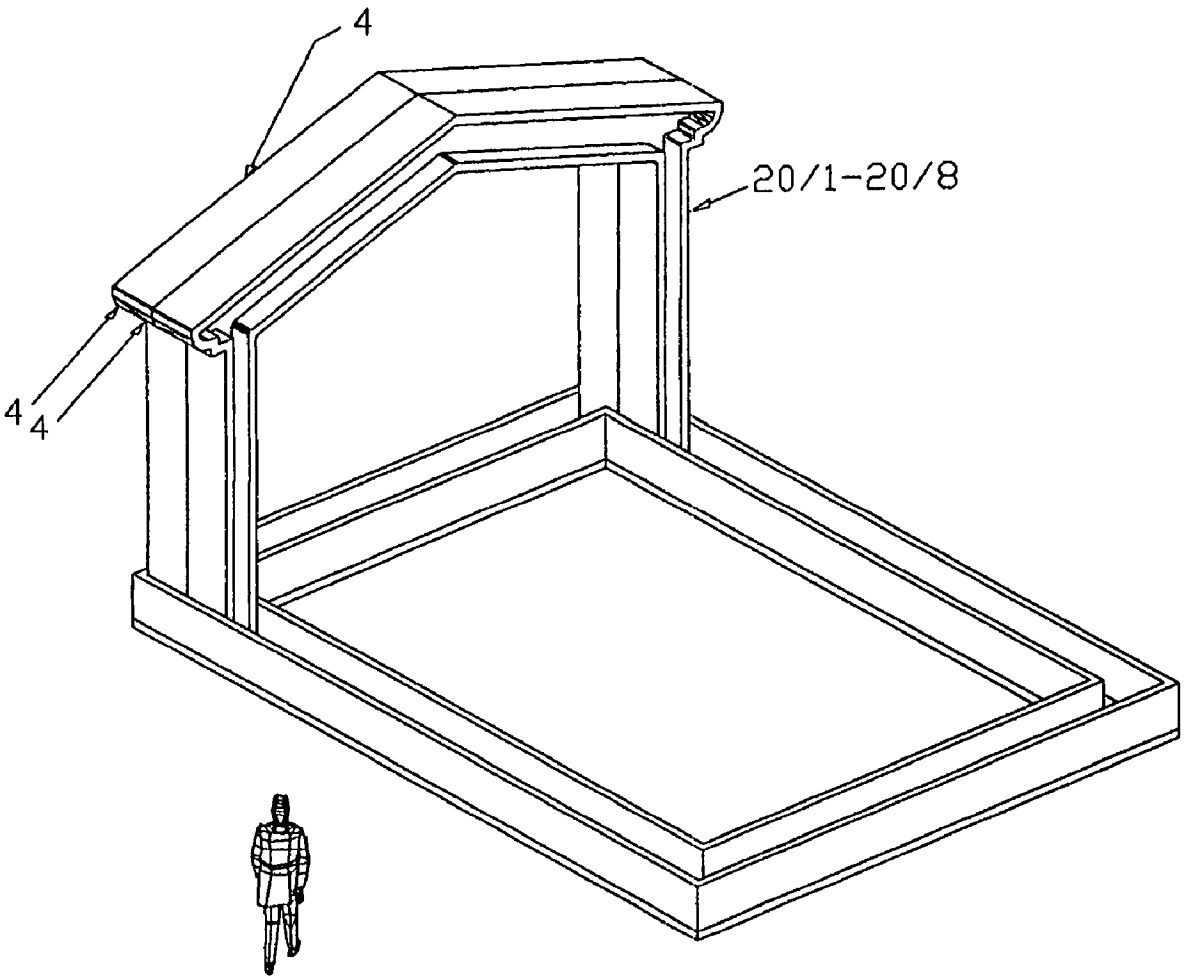
FIG. 10 is a perspective view of the slice and the coatings.

FIG. 10 shows the GFRC coated slice and the various side coatings of the removed and reassembled without the foam core.

Figure 11:
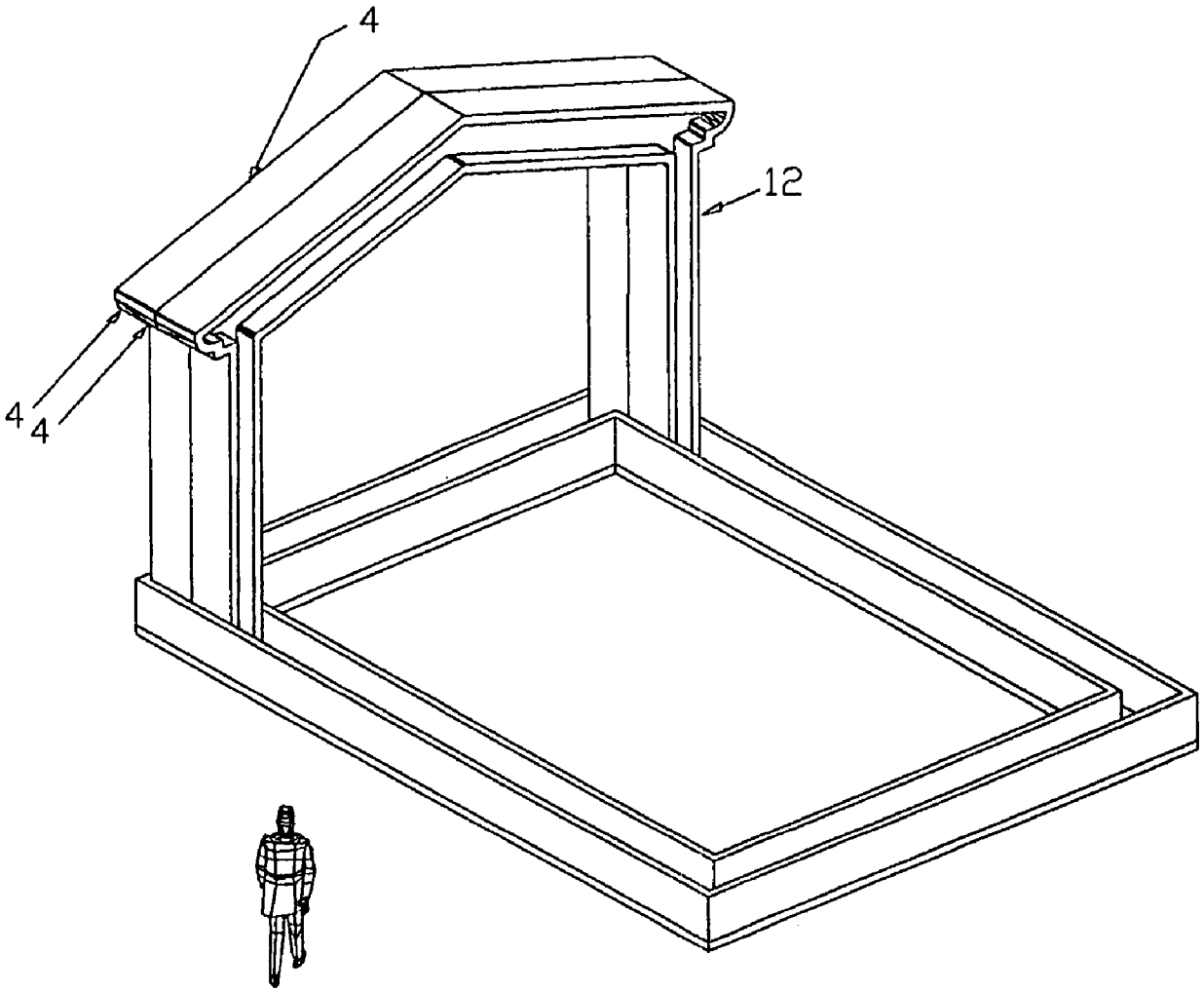
FIG. 11 is a perspective view of three slices joined together.

FIG. 11 shows three slices 4 assembled and positioned on the foundation. Multiple slices can be assembled by gluing at least some surfaces of the side edges 12 together. These abutting side edges 12 are left un-coated with GFRC to help in the adhesion process. However, if they are coated with GFRC, a suitable adhesive could be used.

The slices 4 can be assembled into a group of slices so that the group can be moved as one by cutting a hole through each slice and providing a tensioning member in the aligned holes such as a bolt, washers and a nut.

Figure 12:
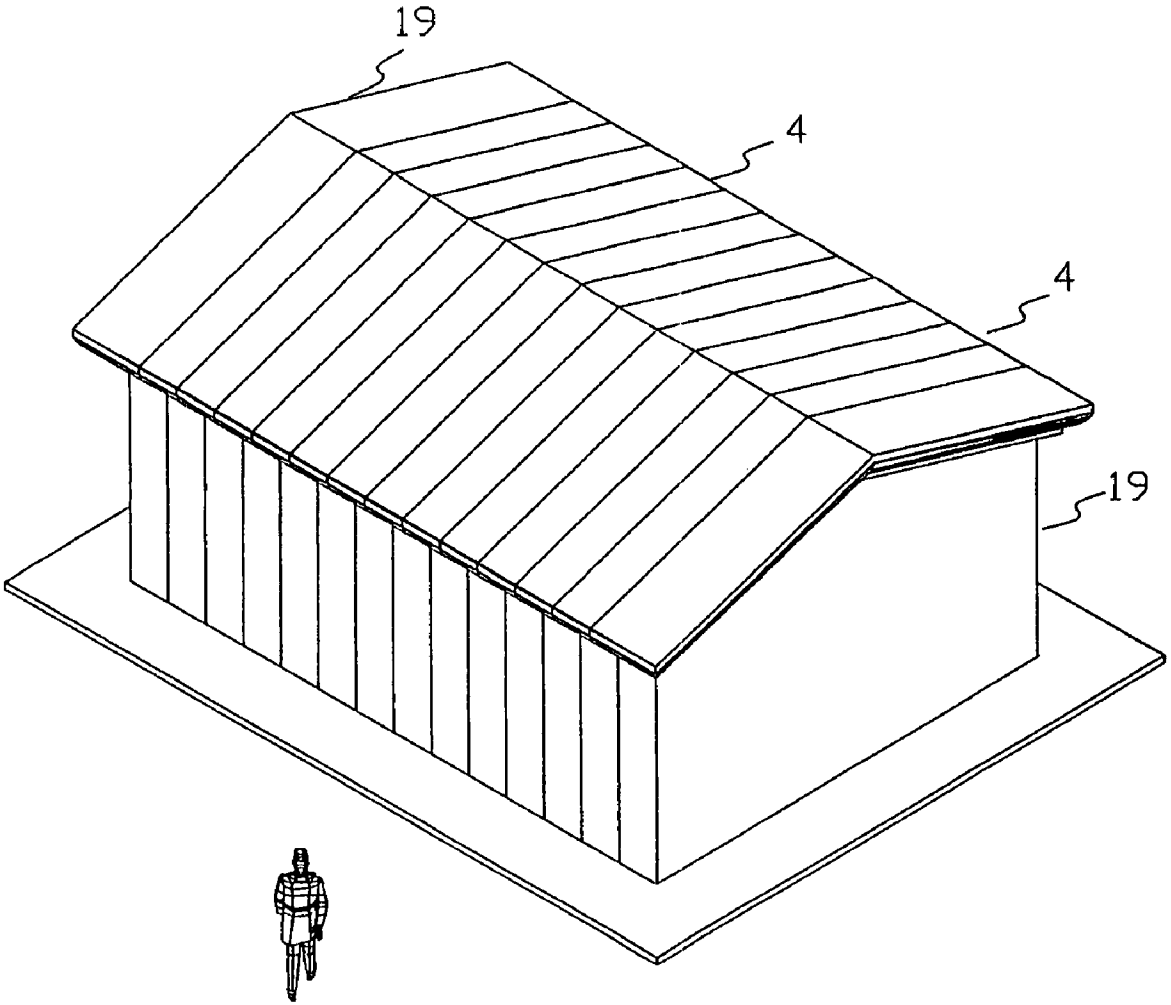
FIG. 12 is a perspective view of the building fully assembled.

FIG. 12 shows the full assembly of the slices 4 including the two end slices 19, which contain the end walls.

Figure 13:
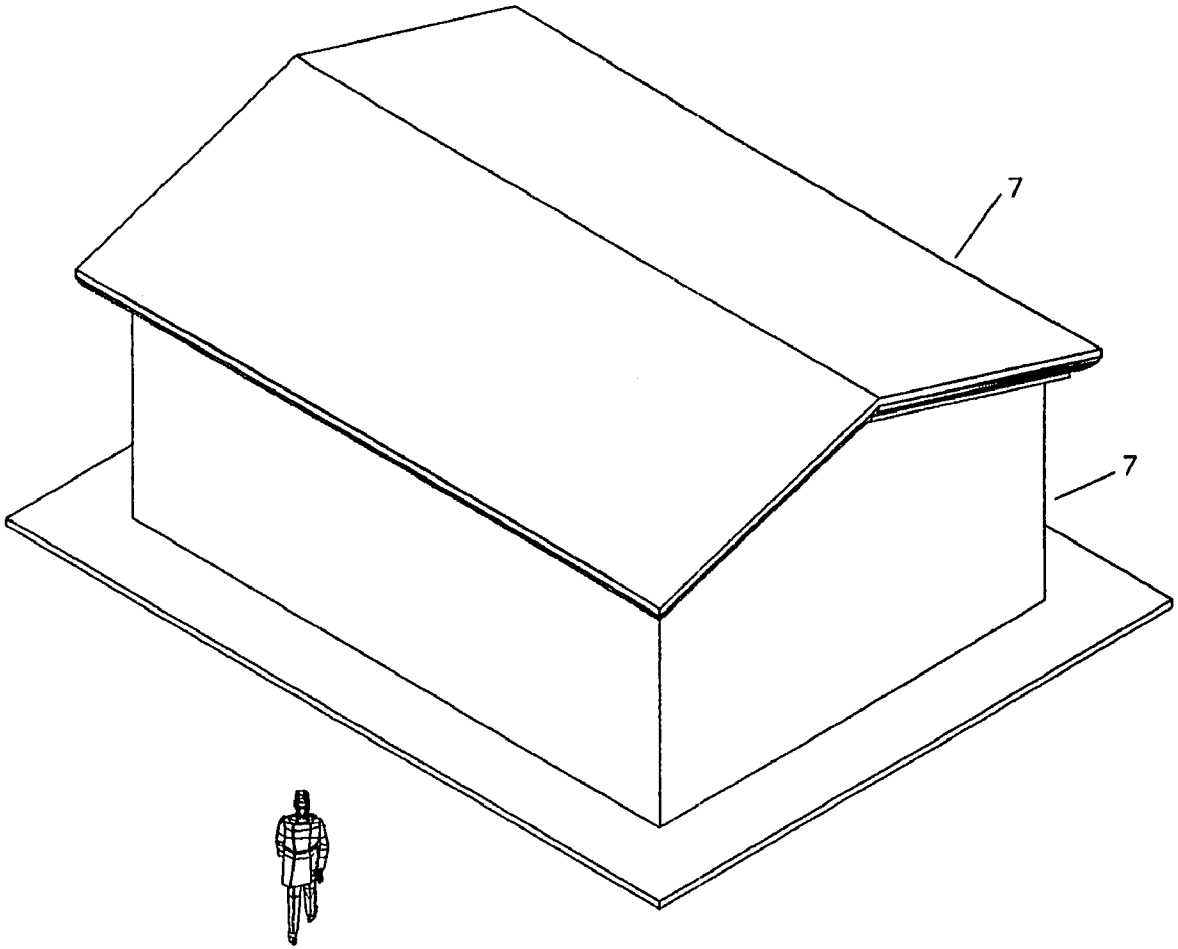
FIG. 13 is a perspective view of the coated building.

FIG. 13 shows the full assembly of slices with a final coating of GFRC 7.

Figure 14:
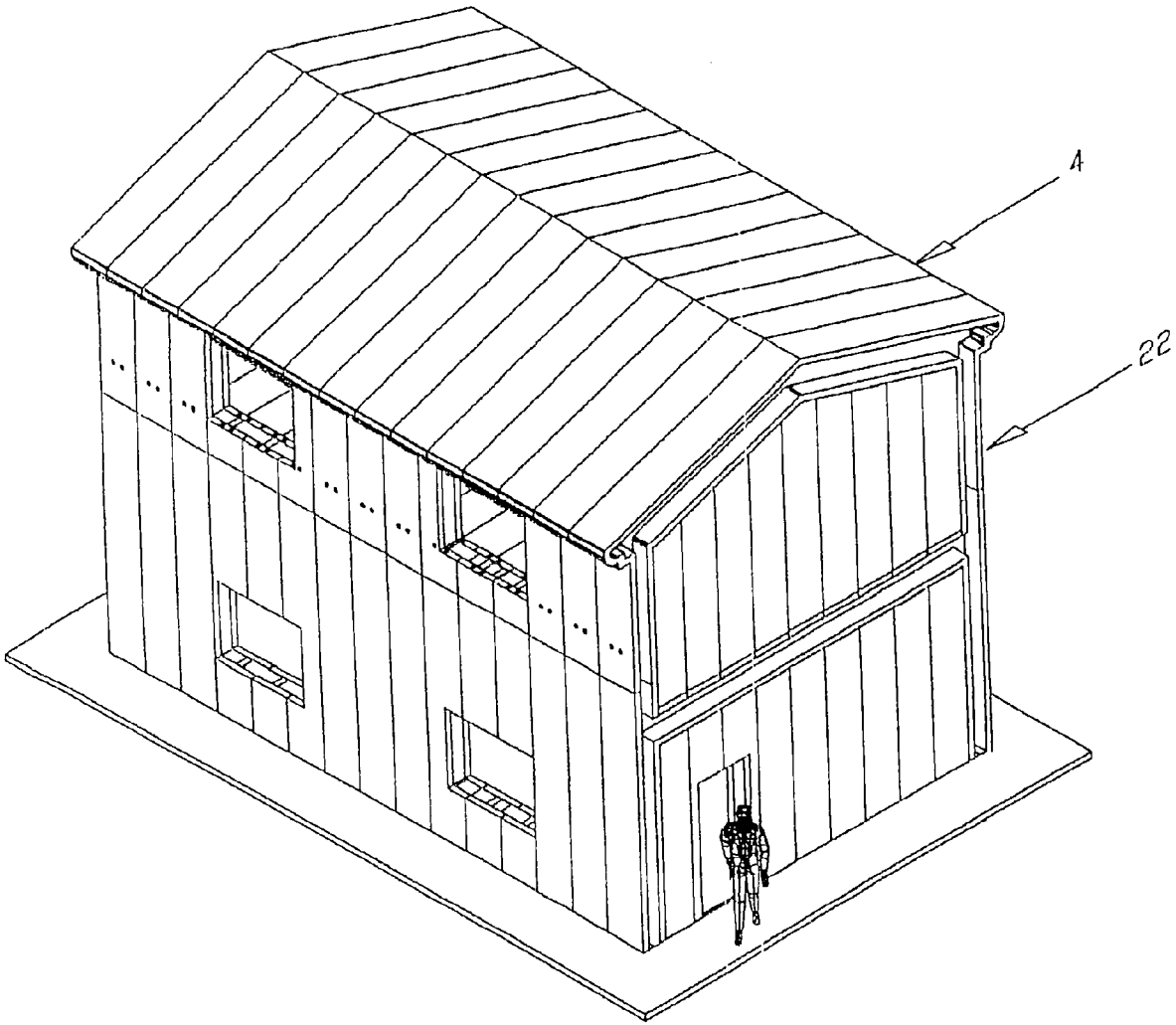
FIG. 14 is a perspective view of a two-story building.

FIG. 14 shows a two-story building 22 without the GFRC final coating 7 applied. More stories can be added by adding more lower story slices 24. As shown the windows and doors can be cut out before the final coating is applied.

Figure 15:
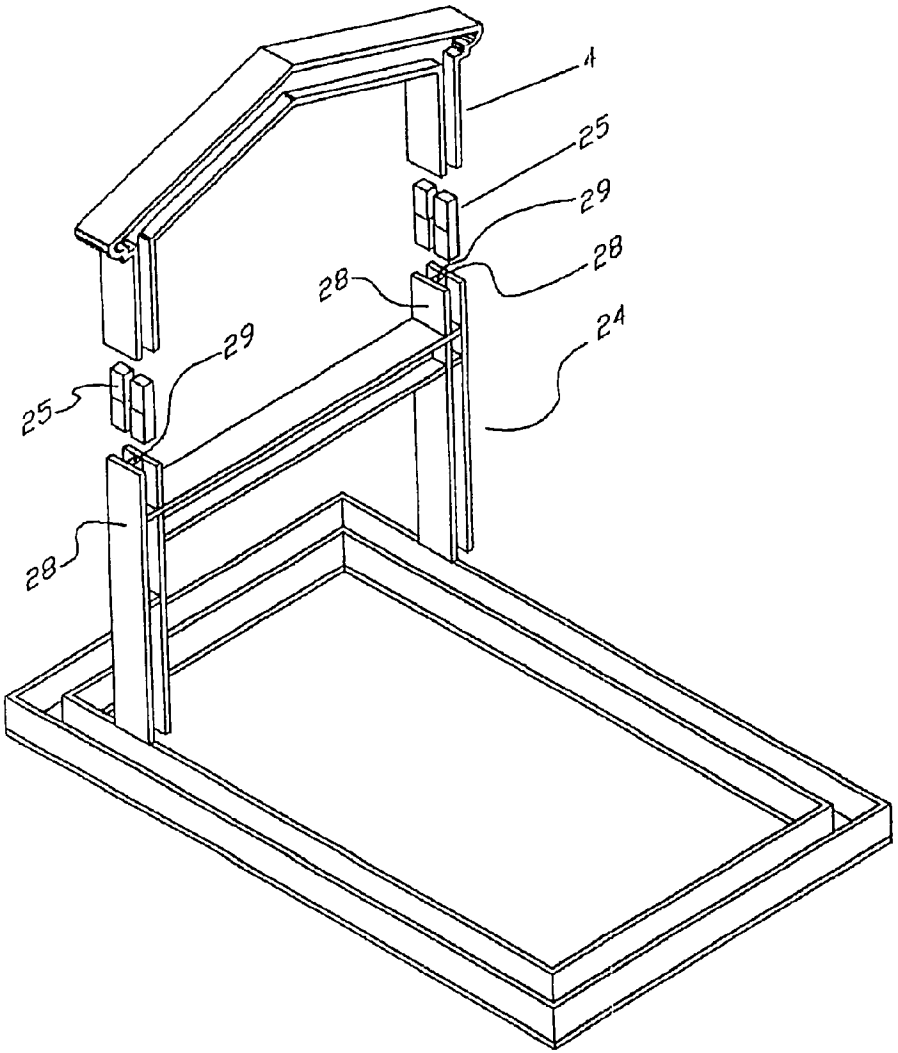
FIG. 15 is an exploded perspective view of the upper and lower slices forming the building of FIG. 14.

FIG. 15 shows two assembled slices exploded. Lower slice 24 is formed in an H-configuration. Upper slice 4 is formed in the same configuration as the single story slice 4 but is shorter in height. Dowels 25 are joined to the lower slice 24 to help align the upper slice 4 for assembly on the lower slice.

Figure 16:
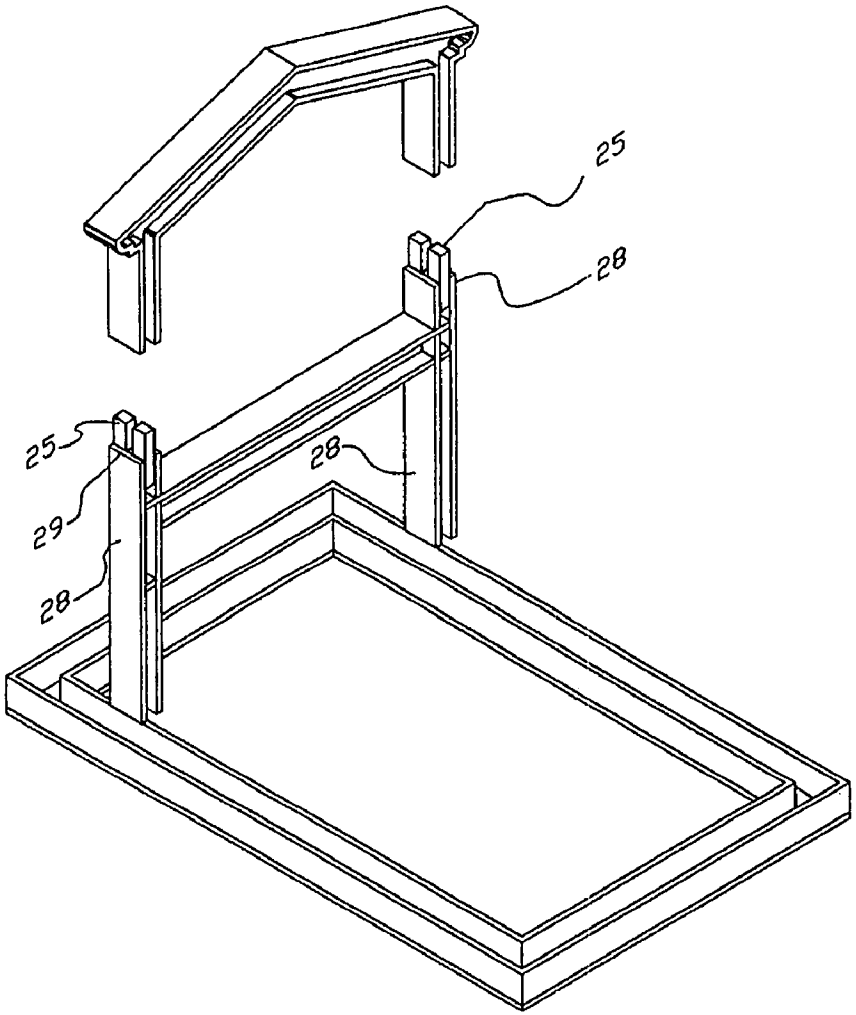
FIGS. 16 and 17 are perspective views of the two slices sequentially assembled.

FIG. 16 shows the dowels 25 joined to the lower slice 24. Dowels 25 are made of foam sized to be smaller than the space between the inner and outer flanges 8 of the lower slice. The foam dowel 25 is coated with GFRC and then adhered to the web 9 and flanges 8 of the lower slice 24 by grout, cement, concrete or GFRC.

Figure 17:
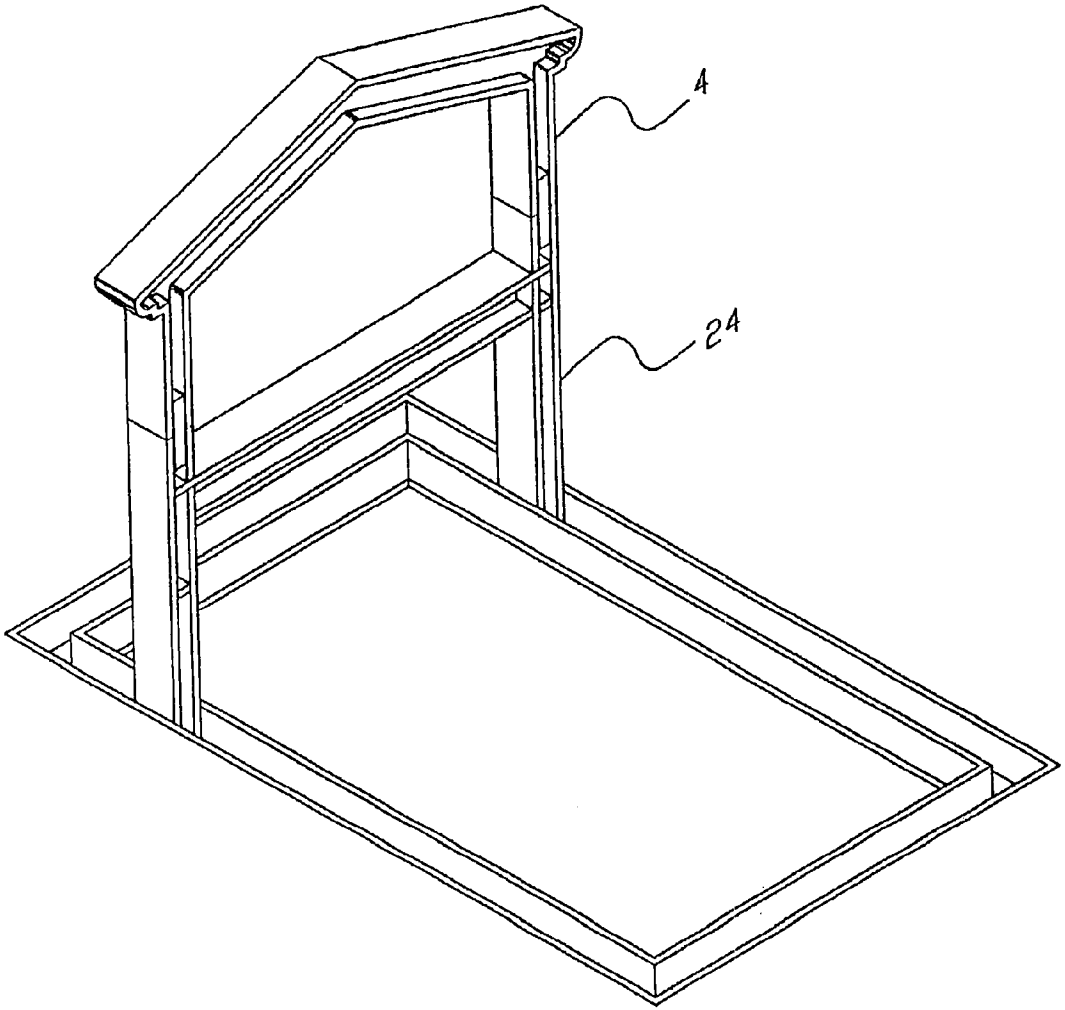

FIG. 17 shows the upper slice 4 and the lower slice 24 assembled without dowels. The assembled upper and lower slice can be coated on any or all surfaces preferably except the abutting edges to strengthen the slices and can be joined to other upper and lower slices as in FIG. 11 and positioned on the footing 3. However, usually, the first story will be built before the second story upper slices are added.

Figure 18:
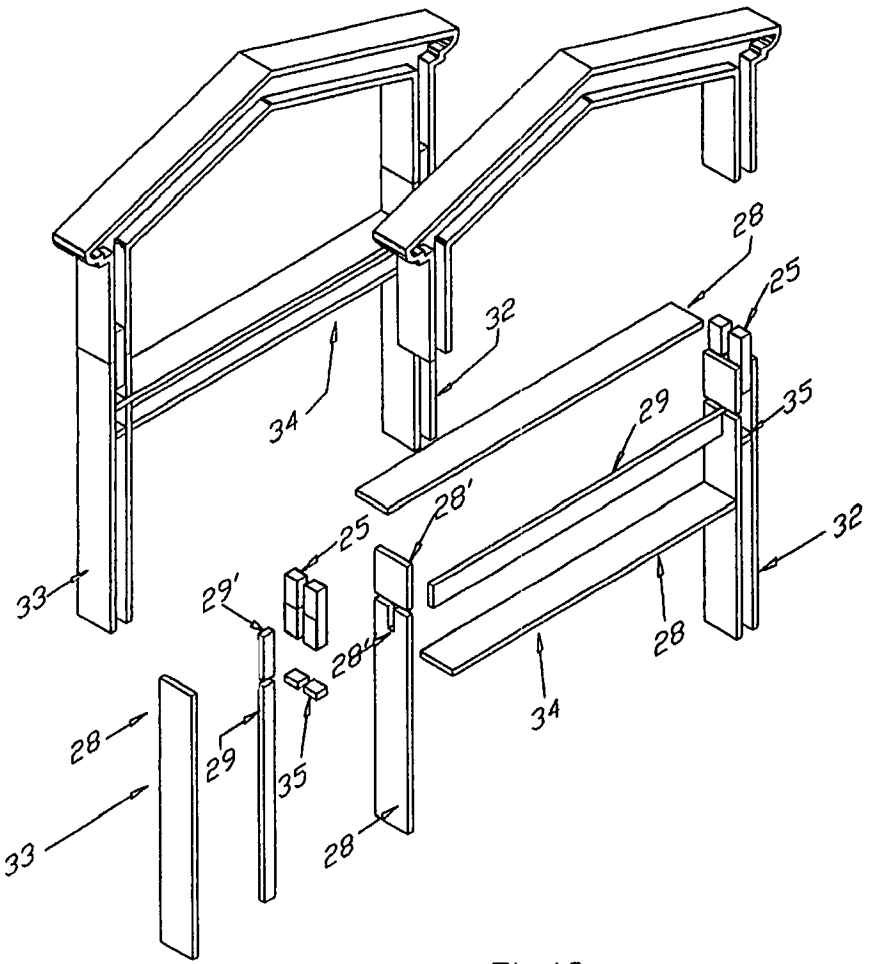
FIG. 18 is a perspective view showing the pieces that make up the lower slice.

FIG. 18 shows an exploded view of the lower slice foam pieces, which form the H. The H is formed by right and left columns 32, 33 and crosspiece 34, all of I-beam cross-section (two flanges joined by a web). The upper slice 4 is shown fully assembled. The four dowels 25 are shown exploded. The columns 32,33 have inner and outer flanges 28 and webs 29. The inner flanges have notch 28" which receive the web 29 of the crosspiece 34. The inner flange 28 and the web 29 of the column are shortened to receive the upper flange 28 of the crosspiece 34. Separate top pieces 28' and 29' are added to complete the inner flange 28 and web 29 of the column 33. Separate sidepieces 35 are added to complete the lower flange 28 of the crosspiece 34. The sidepieces 35 fit between the inner and outer flanges 28 of the columns 32, 33 and are adhered thereto.

Figure 19:
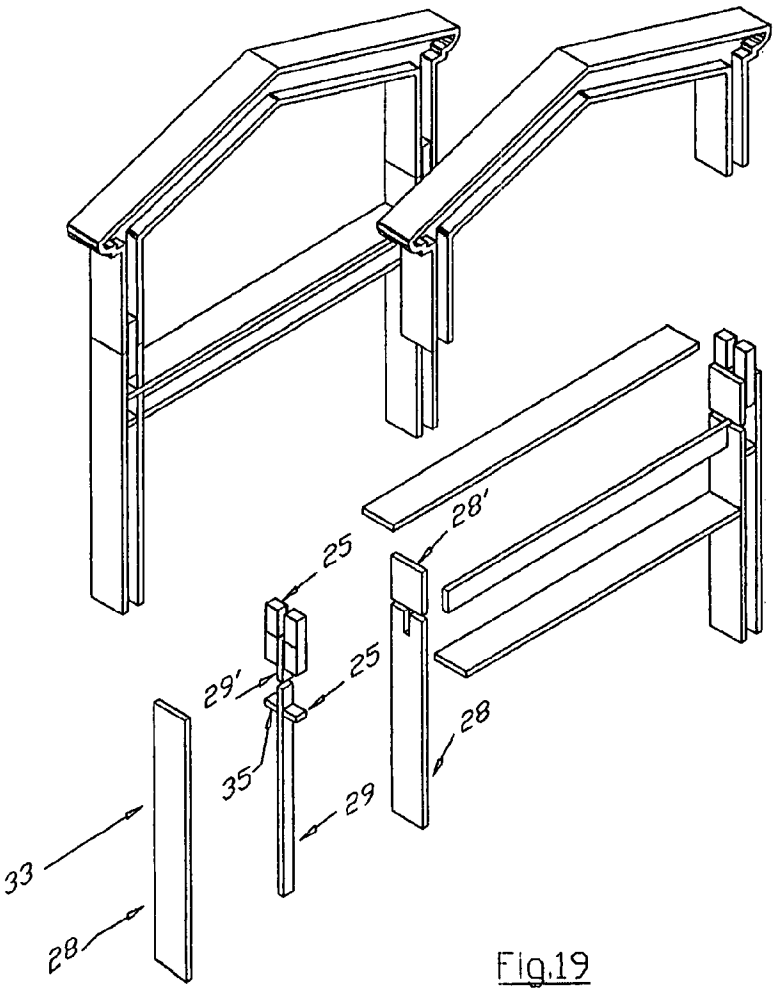
FIG. 19 is a perspective view showing some assembly of the lower slice.

FIG. 19 shows the lower slice web 29 partially assembled on the left side column 33. The top pieces 29', 28' are shown aligned over the web 29 and the inner flange 28. The sidepieces 35 are shown attached to the web 29 but may be attached to the inner and outer flanges 28 and/or the web 29.

Figure 20:
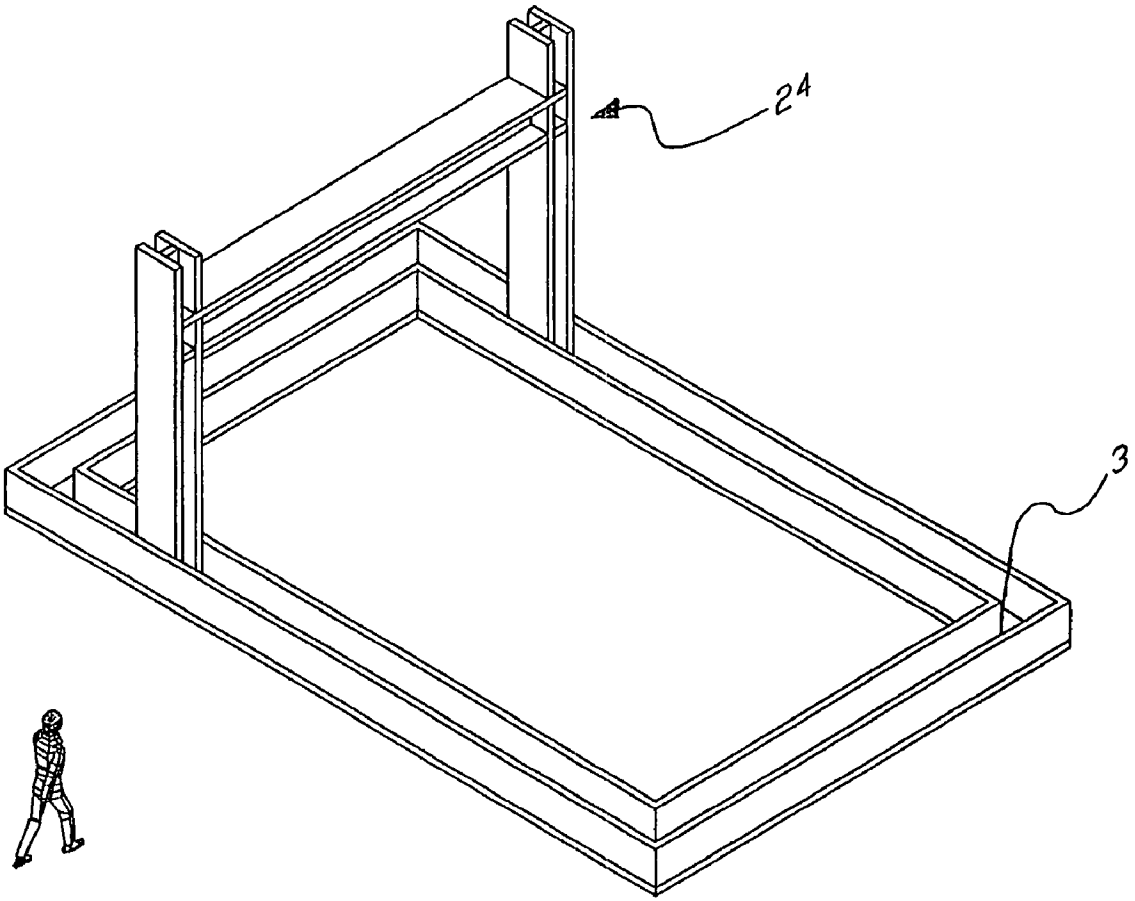
FIG. 20 is a perspective view of the assembled lower slice.

FIG. 20 shows the fully assembled lower slice 24.

Figure 21:
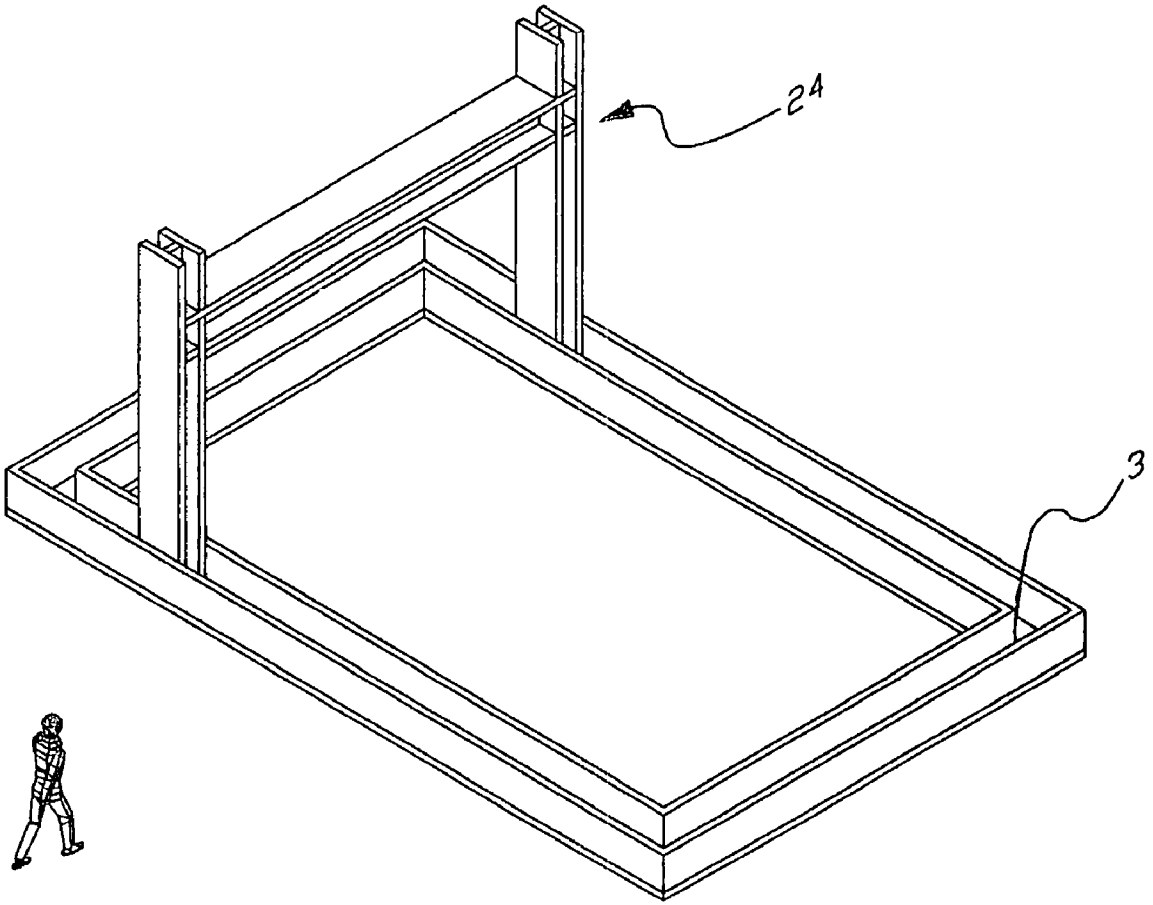
FIG. 21 is a perspective view of the lower slice on the footings.

FIG. 21 shows the lower slice 24 on the footing 3.

Figure 22:
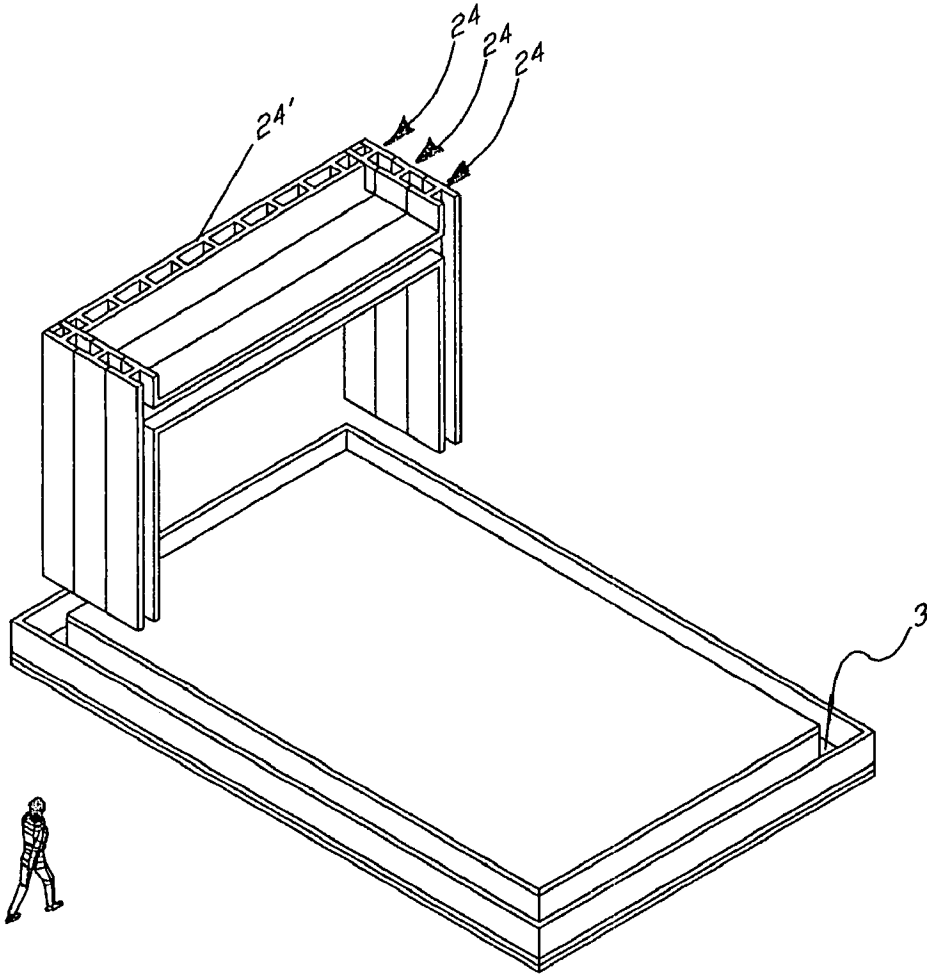
FIG. 22 is a perspective view of some lower slices assembled with an end wall slice.

FIG. 22 shows an assembly of lower slices 24 including an end wall lower slice 24'. In this construction embodiment, the assembly is made prior to the slices being positioned on the footing 3. The assembly is moved on to the footing and adhered thereto.

Figure 23:
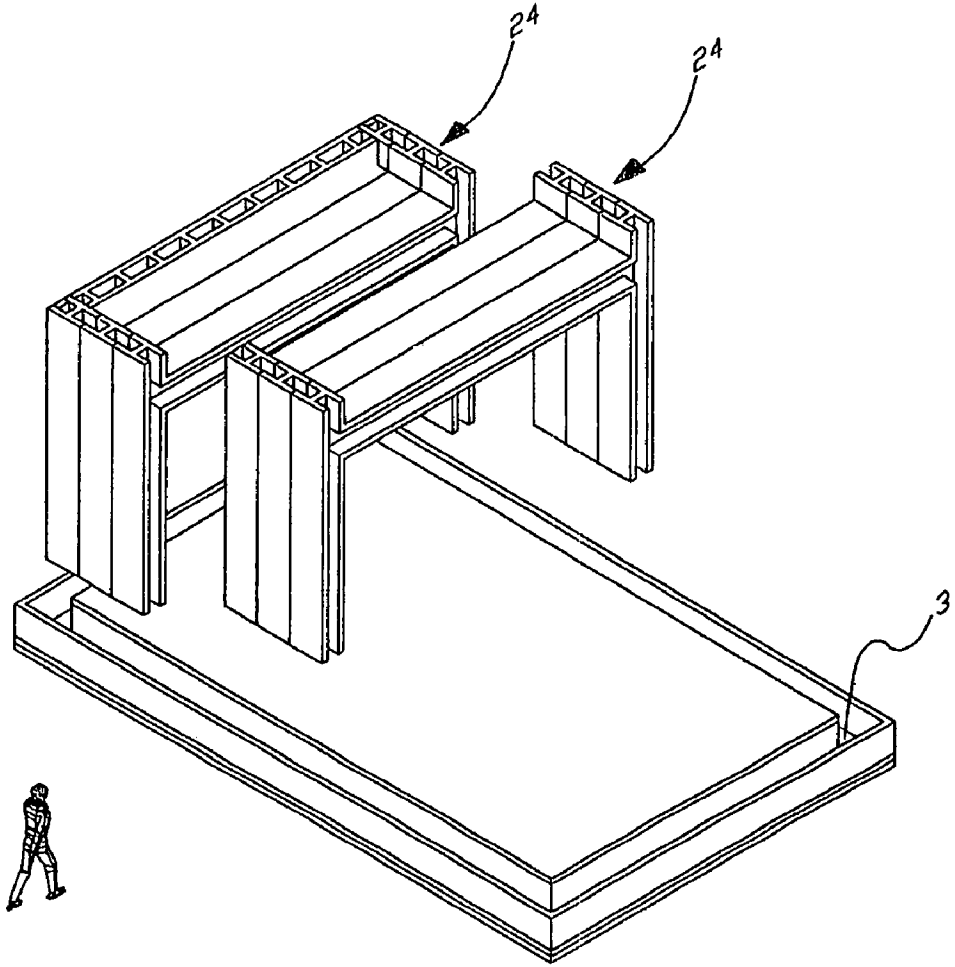
FIGS. 23 and 24 are perspective views of the sequential assembly of the lower slices.
Figure 24:
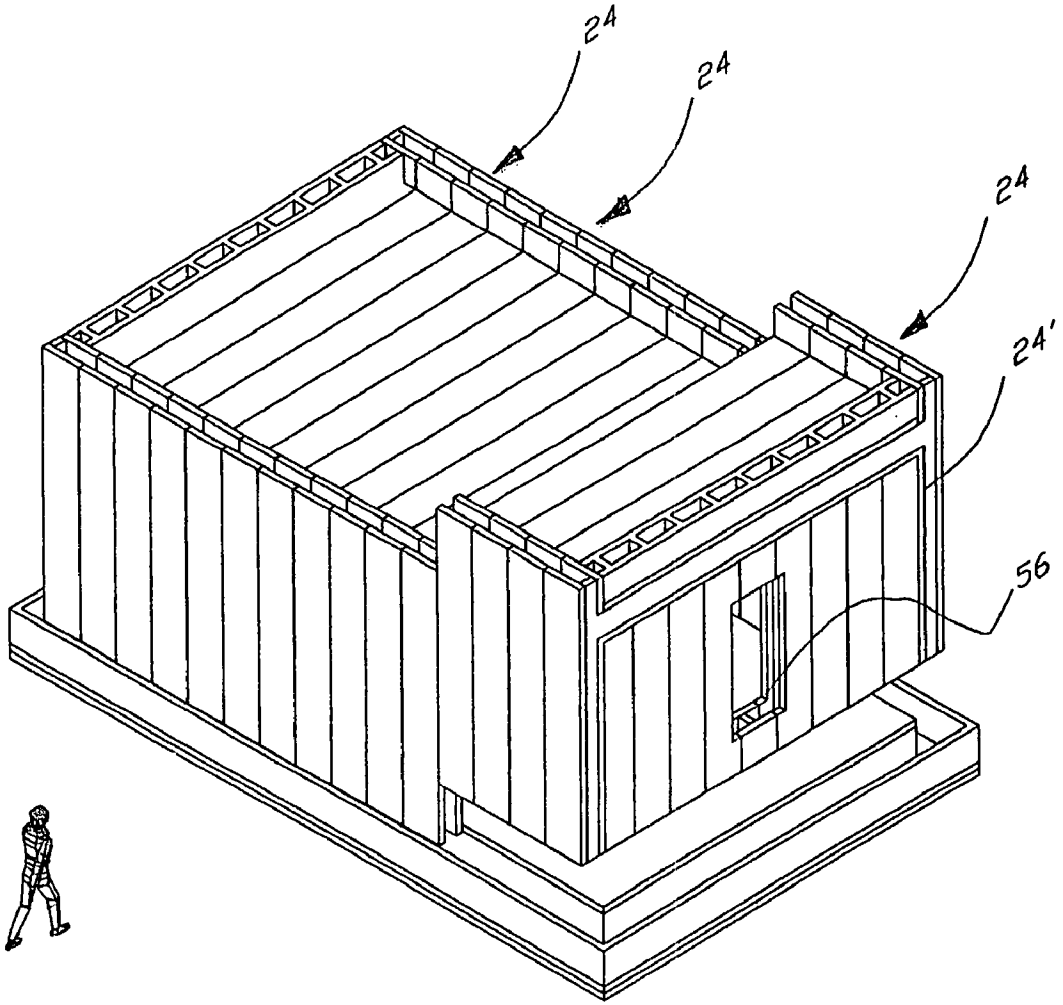

FIGS. 23 and 24 show several more assemblies of slices 24 being joined to the previously positioned slice assembly 24. In FIG. 24, the door 56 is cut out of the foam before it is coated with a coating of GFRC 7.

Figure 25:
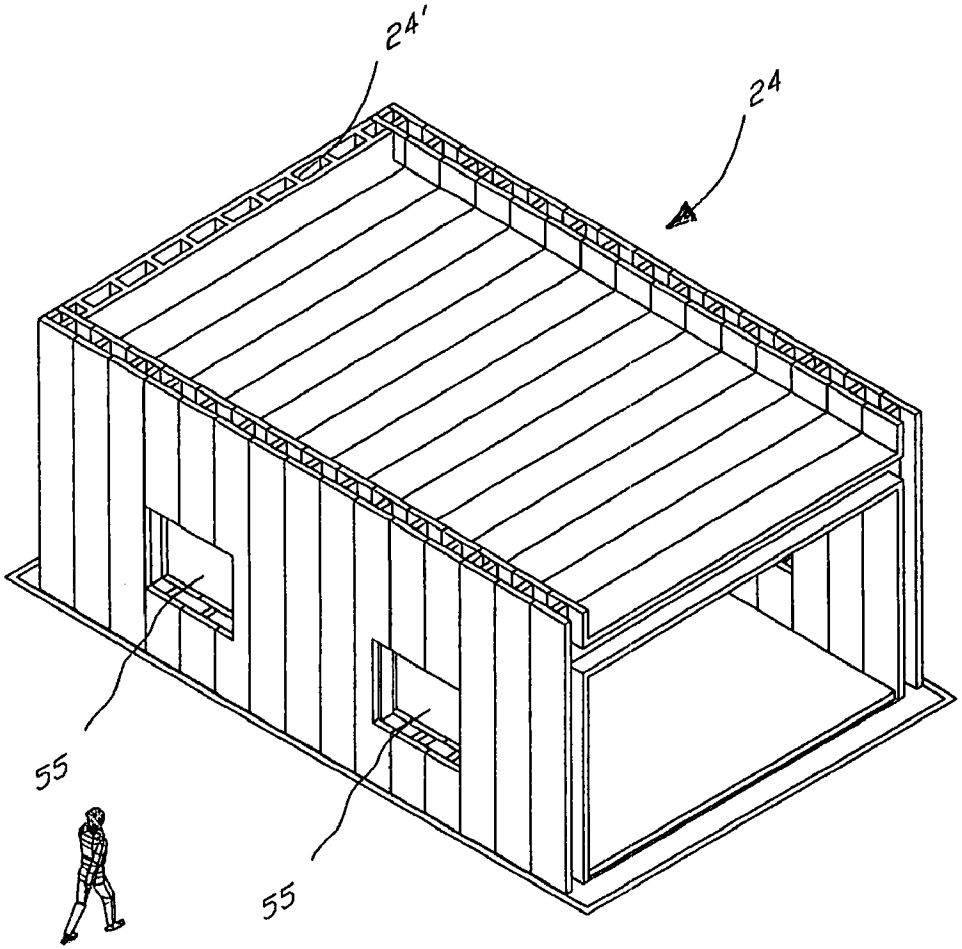
FIG. 25 is a perspective view of the building with the end wall slice removed.

FIG. 25 shows the complete lower slice portion of the building with one end wall slice 24' removed to more clearly show the inside of the building and walls. In this figure, the windows 55 have been cut out of the foam walls before the walls are coated with GFRC 7.

Figure 26:
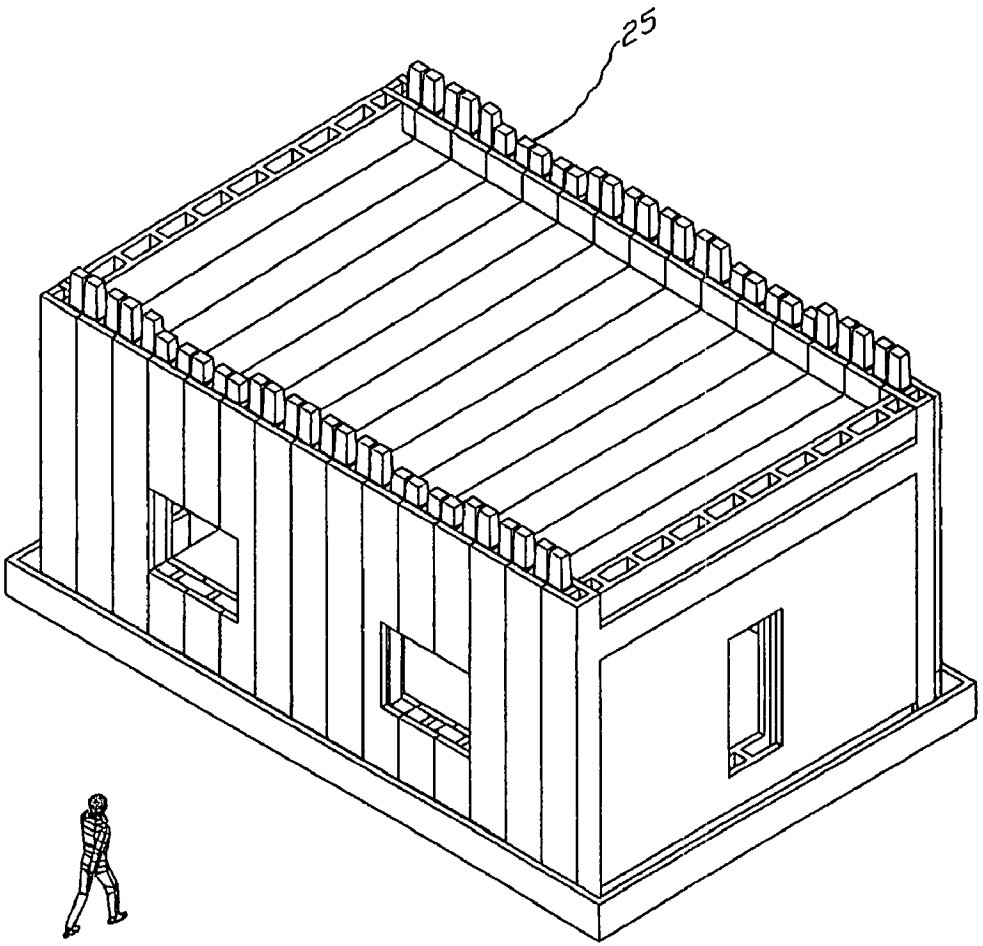
FIG. 26 is a perspective view of the building with the dowels assembled.

FIG. 26 shows the assembled lower slices 24 without windows but with the dowels 25 inserted. The dowels 25 can be inserted and joined to the slice 24 before or after it is joined to other slices 24. Preferably, the dowels 25 are coated with GFRC and adhered to the walls of the I-beam that they are inserted into. As shown, the dowels 25 are smaller at sections where windows 55 will be cut there above.

Figure 27:
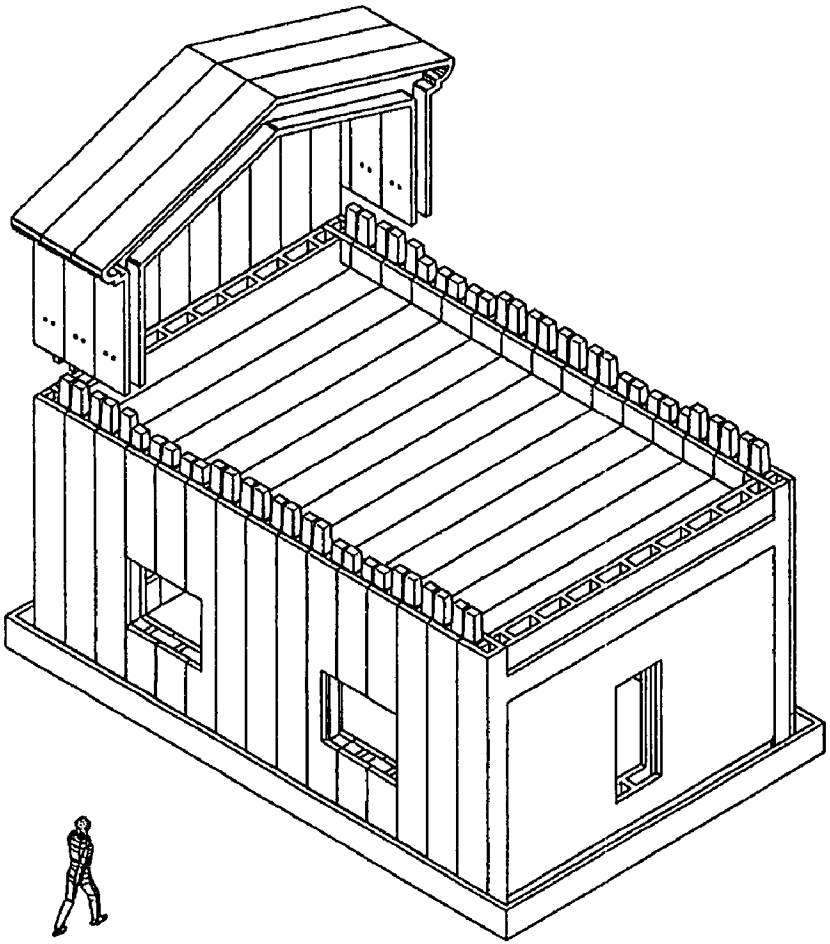
FIGS. 27, 28 and 29 are perspective views of groups of upper slices positioned for assembly on the lower portions of the building.
Figure 28:
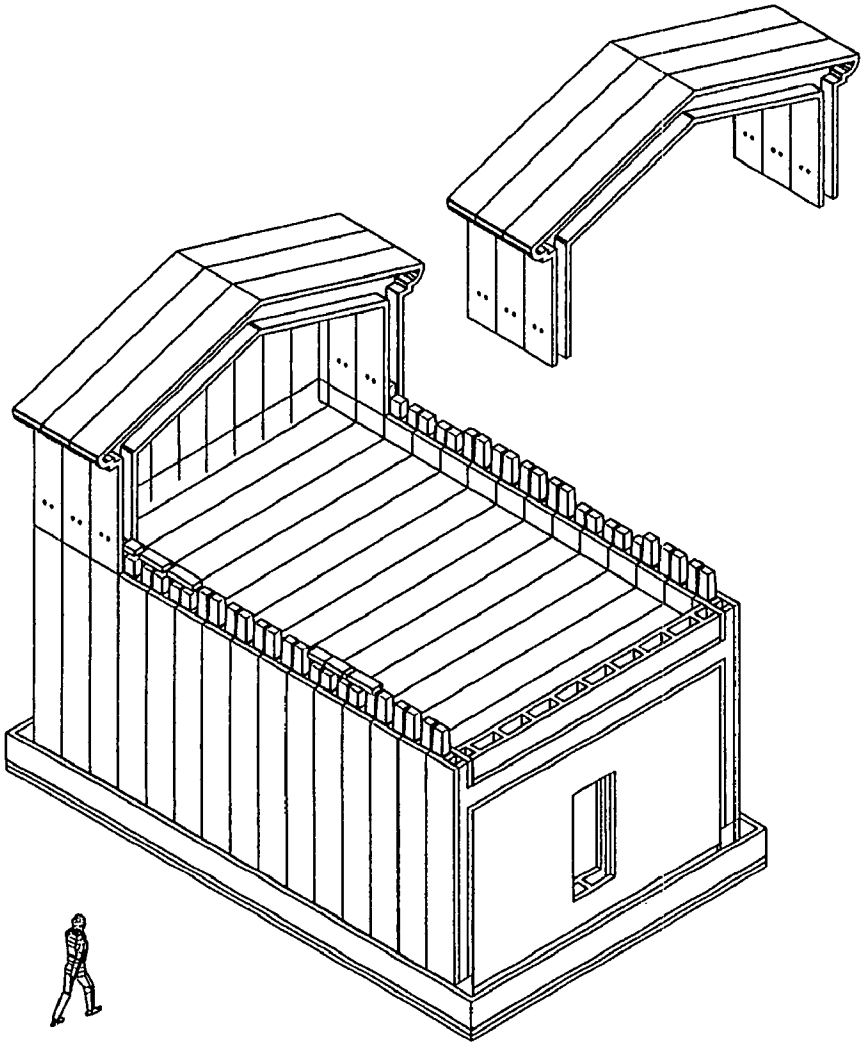
Figure 29:
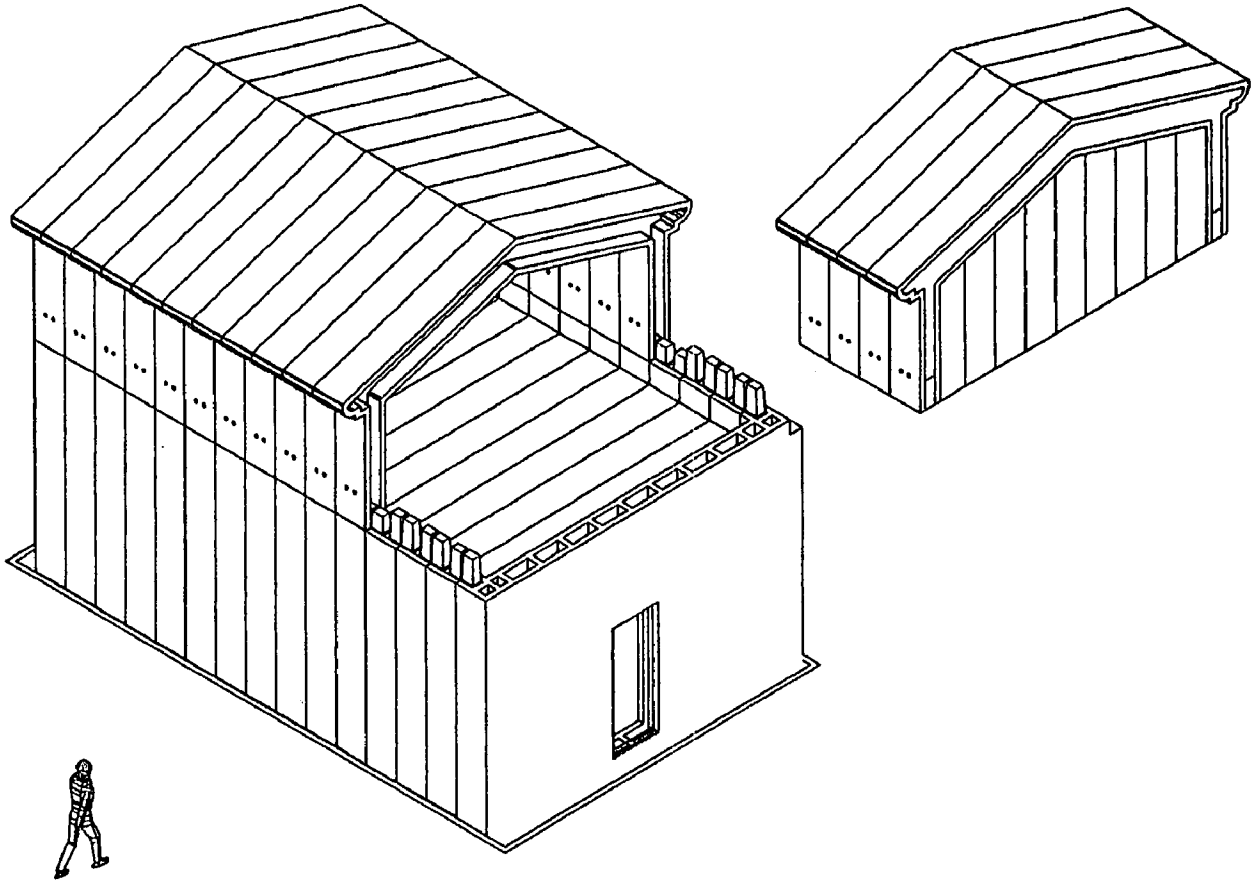

FIGS. 27, 28 and 29 show upper slice assemblies 4 being placed on top of the lower slice full assembly. The dowels 25 assist in this positioning. At least some of the internal walls of the I-beam cross-section of the slices are previously coated with GFRC. Preferably, the foam dowels 25 coated with GFRC are adhered to these previously coated or non-coated walls. Preferably, grout is used to adhere the dowels 25 to the walls, but GFRC, non-reinforced cement/concrete or other appropriate adhesive can be used.

Figure 29A:
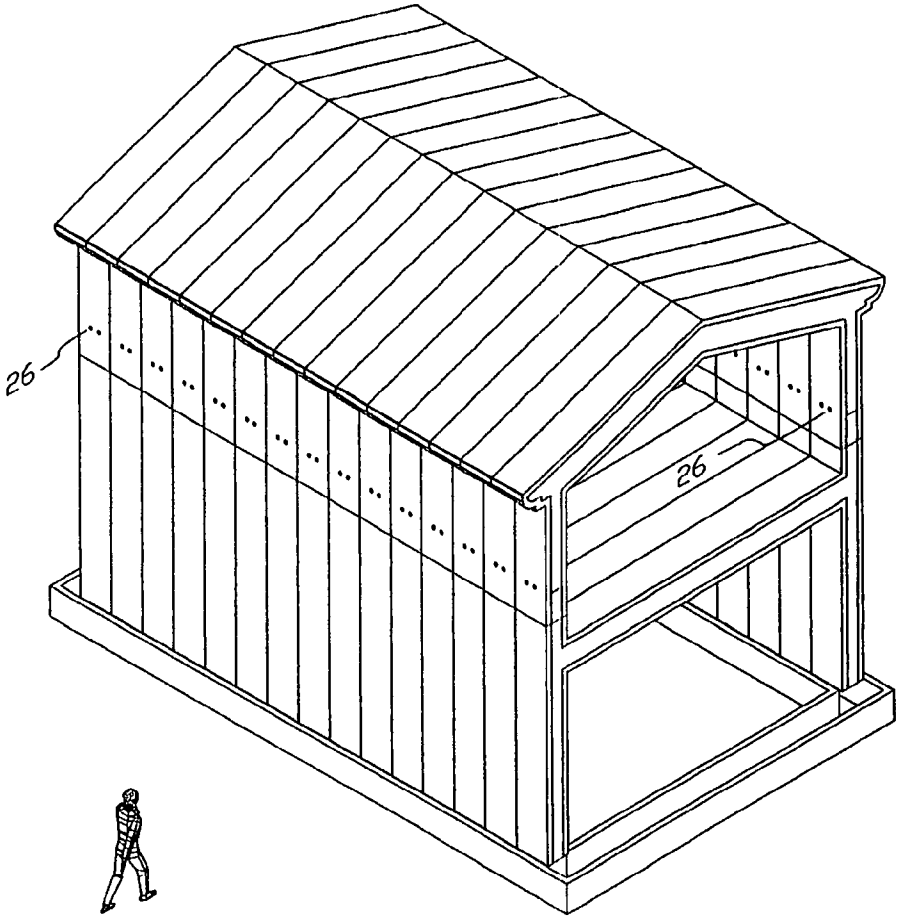
FIG. 29A is a perspective of the two story building with the end wall removed.

FIG. 29A shows a variation of the two story building in which the building ends are added after the in-between slices/sections are added. Holes 26 are provided in the inner and outer walls to assist in feeding grout into the areas around the dowels 25.

The slice formed building of FIGS. 1-29A can also be formed from a full C-Beam slice 44 instead of the I-Beam slice 4. The full C-Beam slice 44 is shown in FIGS. 30-32, 32A and 33-42. The full slice 44 can be made without the use of dowels. The slice 44 is built, coated with GFRC on some surfaces, if needed, raised and positioned on the footings as one piece.

Figure 30:
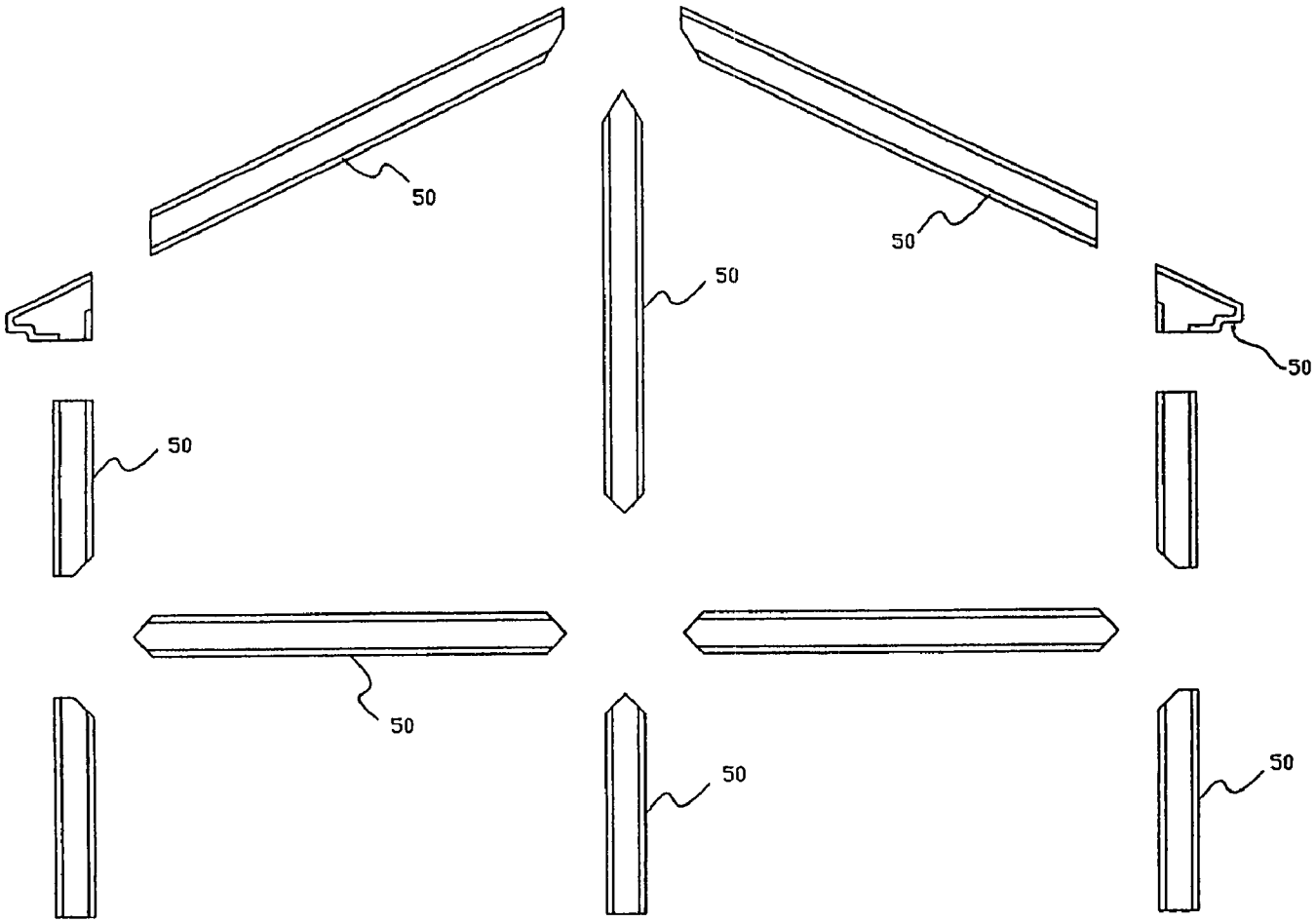
FIG. 30 is an exploded frontal view of the pieces which make another embodiment of a two story slice.

FIG. 30 shows an exploded frontal view of a slice 44 of the building.

Figure 31:
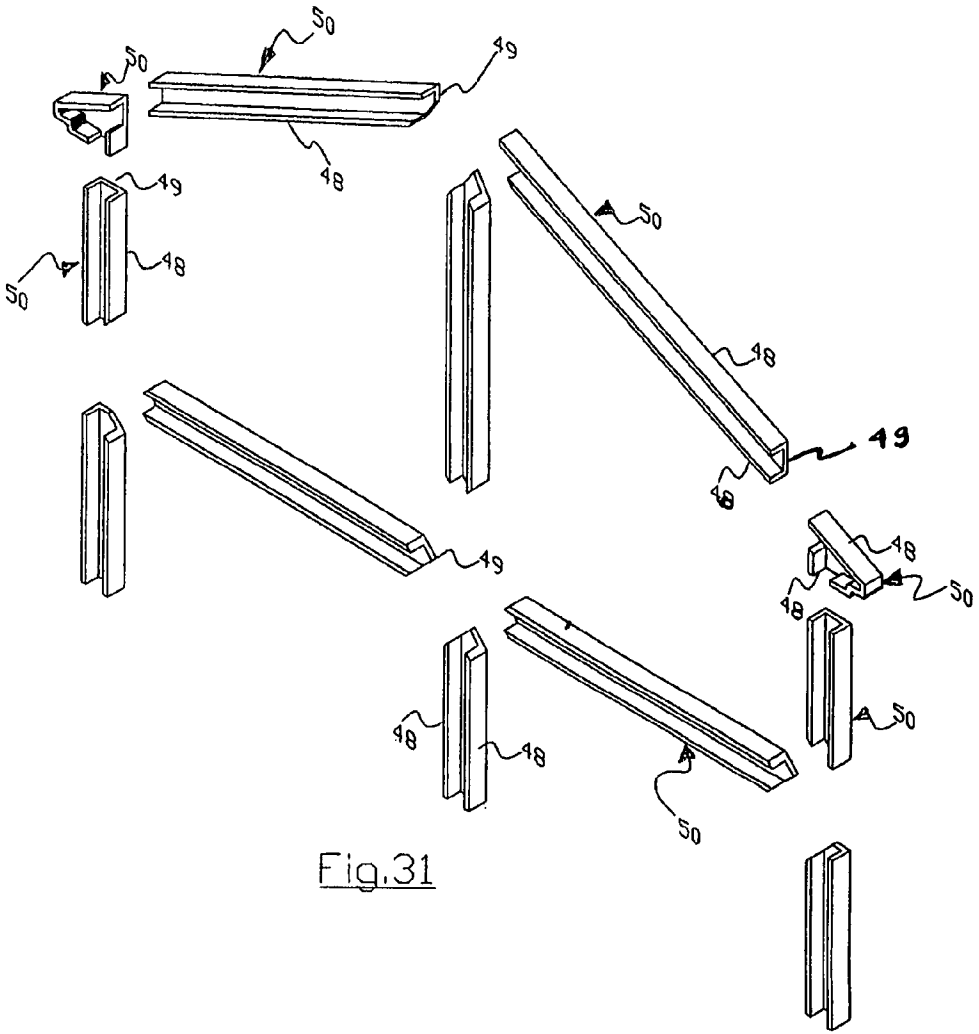
FIG. 31 is a perspective view of FIG. 30.

FIG. 31 shows an exploded perspective view of the slice 44 of FIG. 30. The C-Beam slice 44 is made as in FIGS. 18, 19 from pieces of foam that are joined by adhesives. The C-Beams 50 are formed from flanges 48 and webs 49. The web 9 of the I-Beam 10 lies in the mid-plane of the I-shaped element. The web 49 of the C-Beam 50 connects the flanges 48 and lies on one of the sides of the C-shaped element. In this embodiment, there is an angled ceiling or a portion thereof formed by the bottom flange 48 of the beam 50. The top flange 48 of the beam forms the roof or a portion of the roof. Web 49 of the beam forms the rafter.

Figure 32:
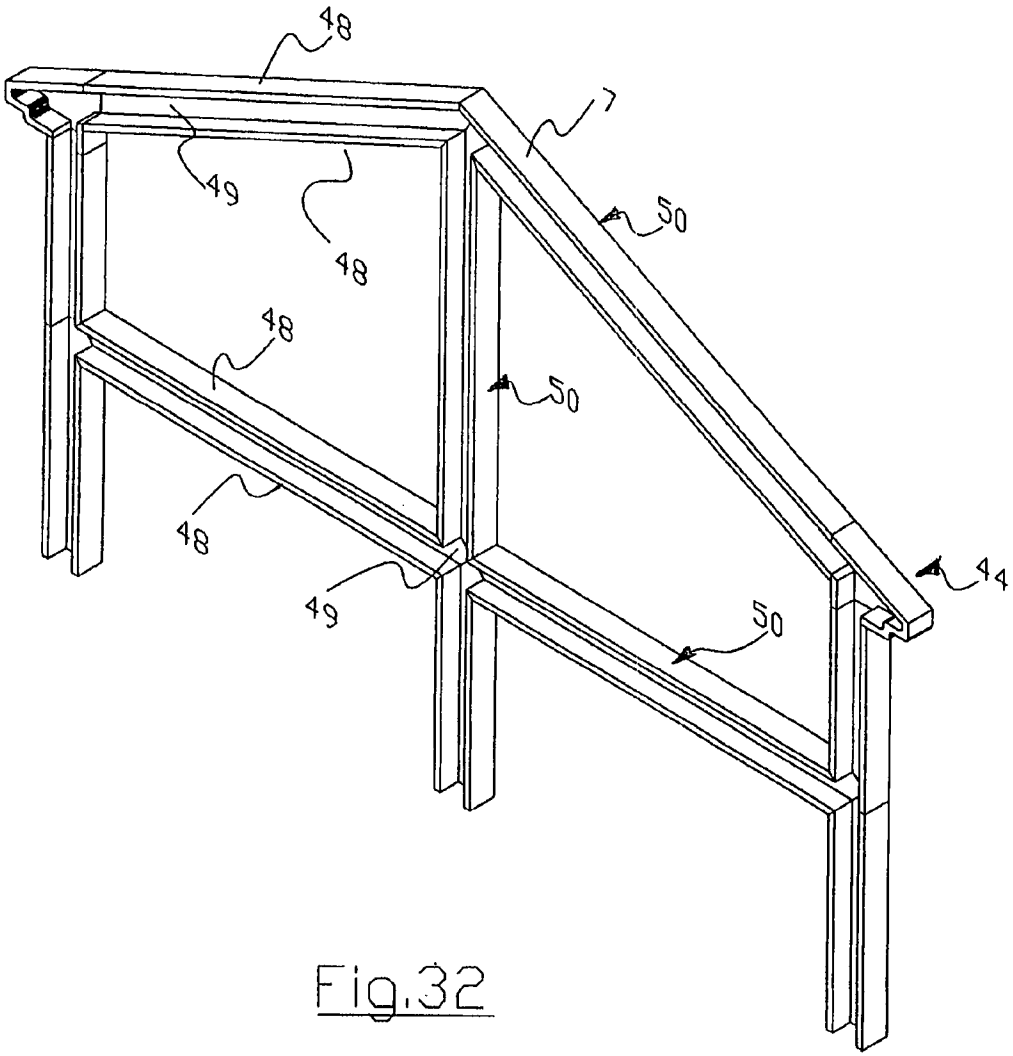
FIG. 32 is a perspective view of the assembled slice of FIG. 30.

FIG. 32 shows a perspective view of the C-Beam slice 44 formed by joining the C-Beam pieces of FIG. 31 by adhesives. The walls of the slice are shown as coated by GFRC 7; however, the coating need not be applied before being positioned on the footings and need not cover all surfaces, especially the abutting surfaces.

Figure 32A:
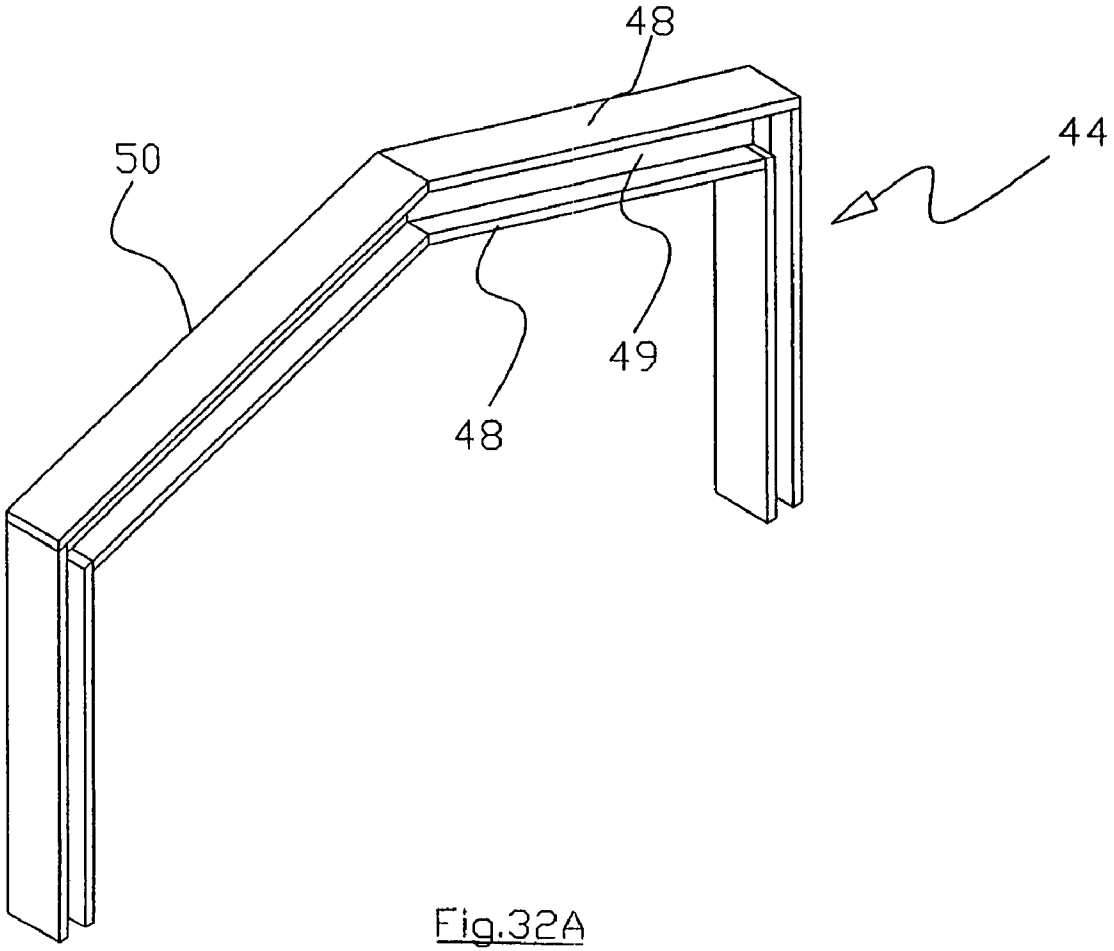
FIG. 32A is a perspective view of a different embodiment of the C-Beam of FIG. 30.

FIG. 32A shows a perspective view of a different embodiment of the full C-Beam slice 44. The span of this configuration can be at least 20 feet which makes it ideal for modern homes. It is noted that the foam pieces are joined at different points in this embodiment.

Figure 33:
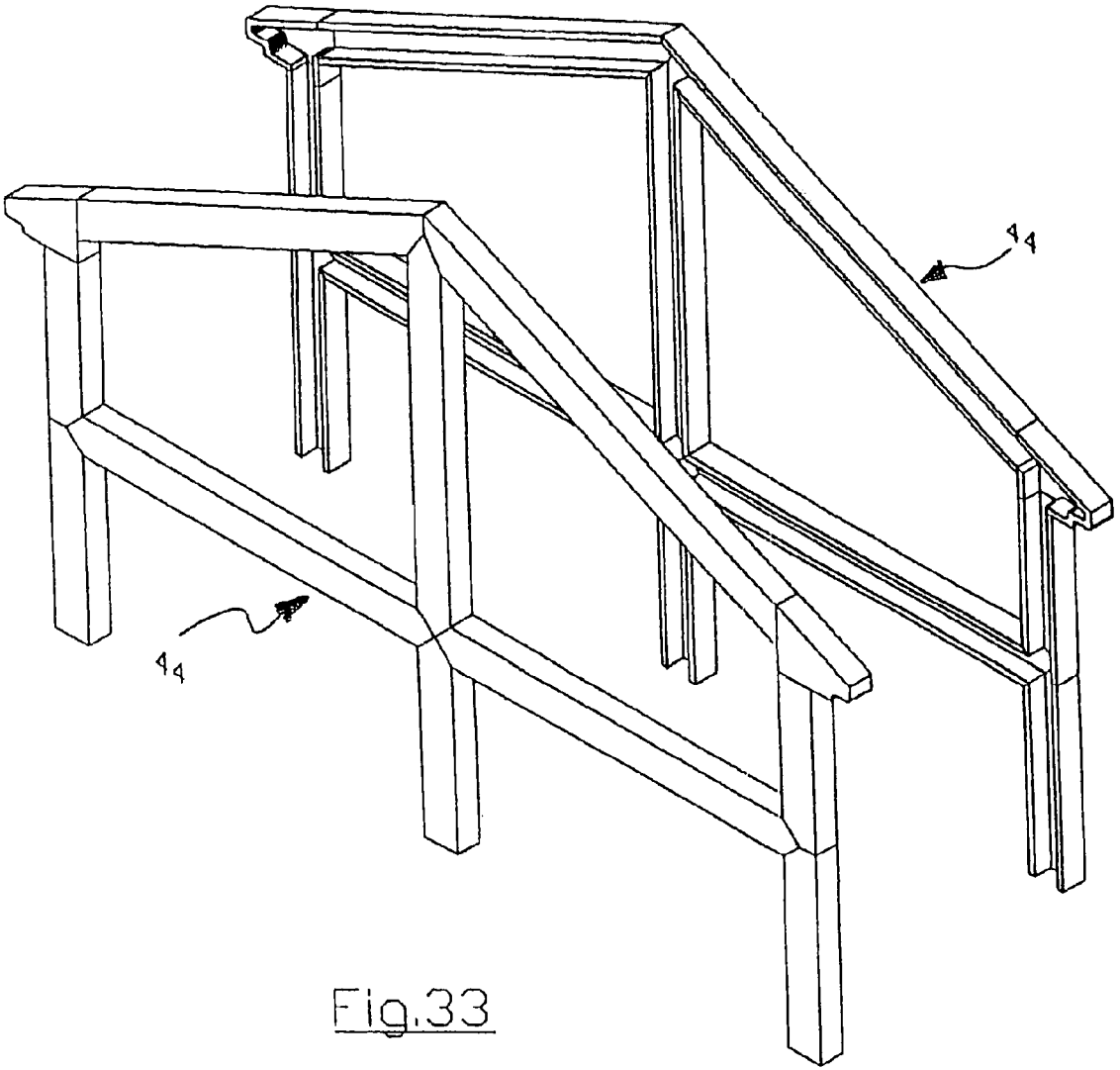
FIG. 33 is a perspective view of two slices oriented for joining.

FIG. 33 shows a perspective view of two C-Beam slices 44 prior to their being joined to each other by adhesives.

Figure 34:
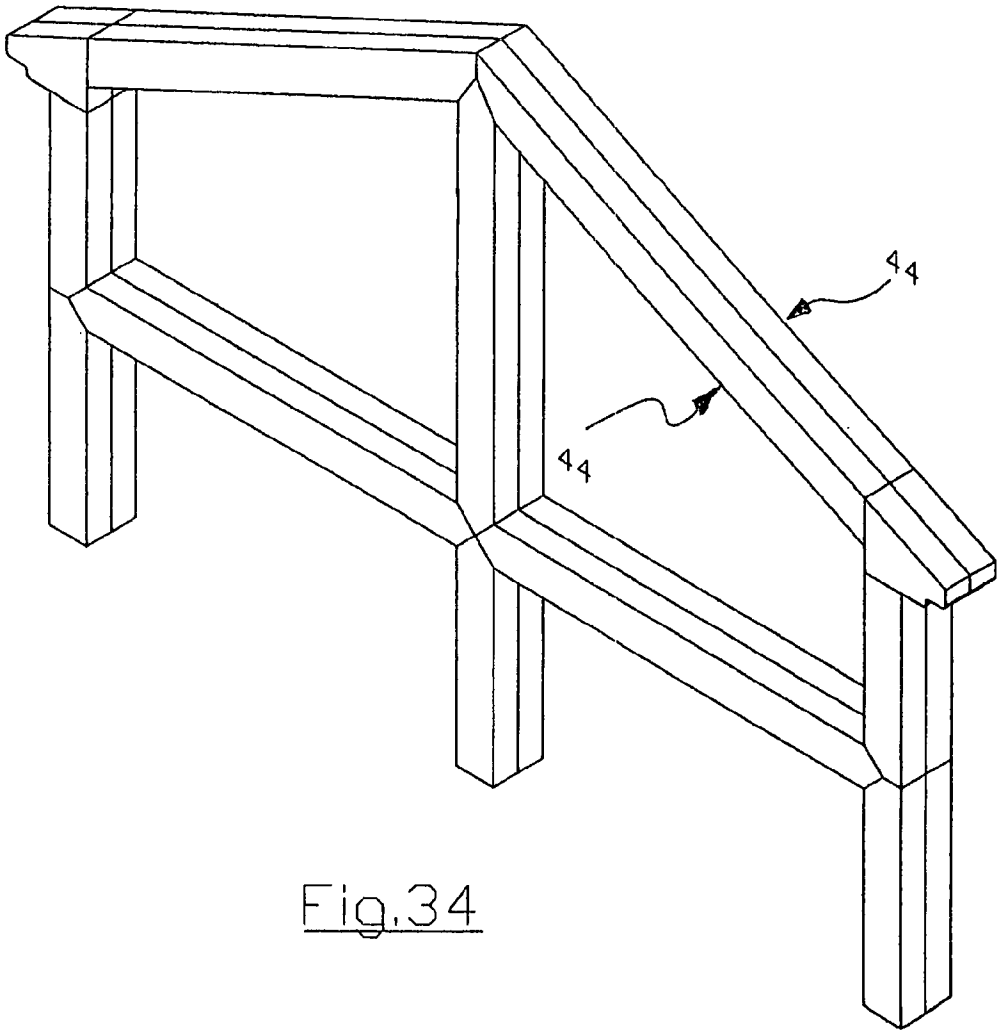
FIG. 34 is a perspective view of the joined slices.

FIG. 34 shows a perspective view of the two C-Beams of FIG. 33 joined together along their abutting edges, the edges of the flanges 48, by adhesives.

Figure 35:
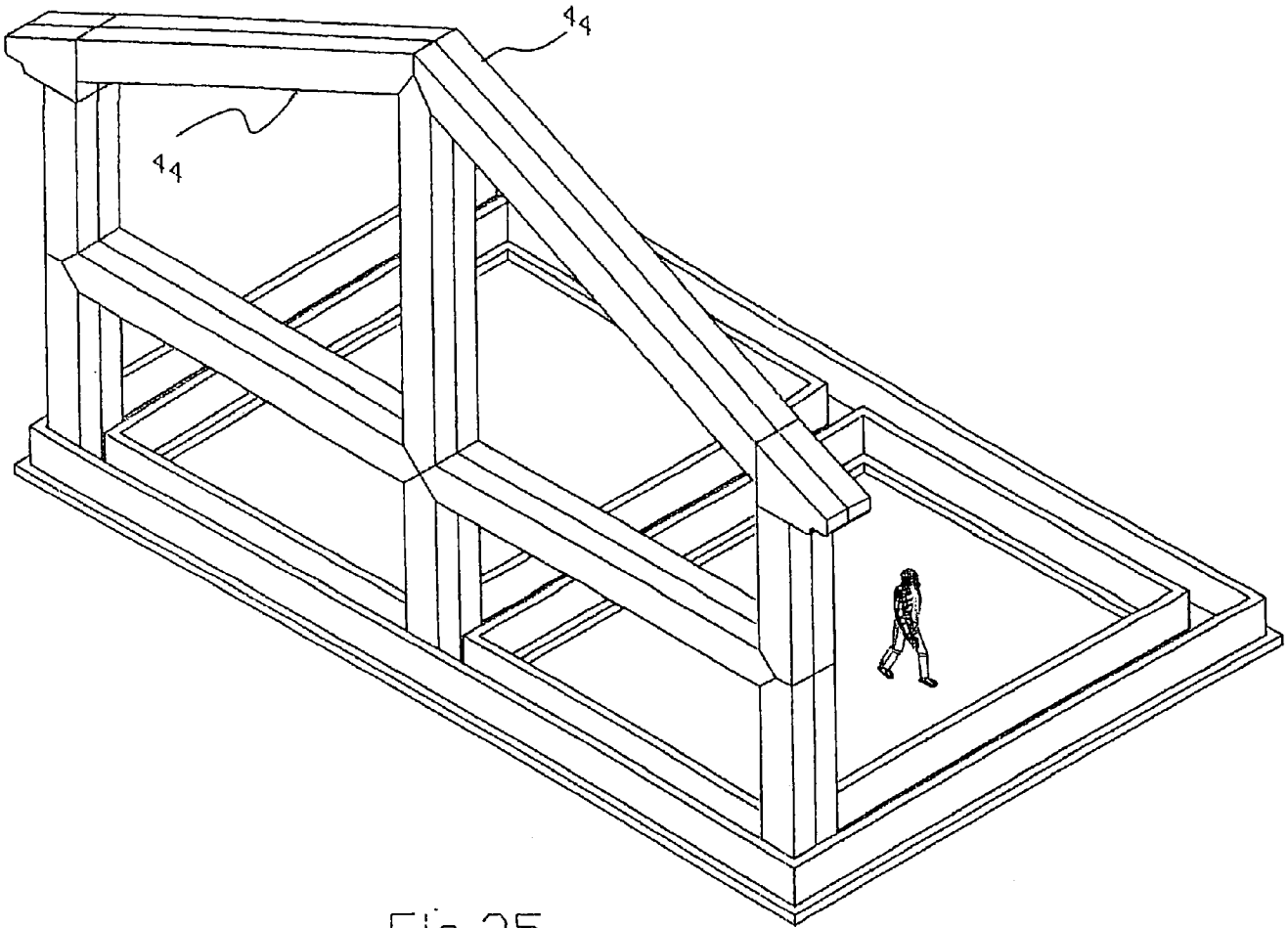
FIG. 35 is a perspective view of the assembled slices positioned on the footings.

FIG. 35 is a perspective view showing the two joined slices 44 positioned on the footings 3. The back-fill dirt 6 is not shown in this figure.

Figure 36:
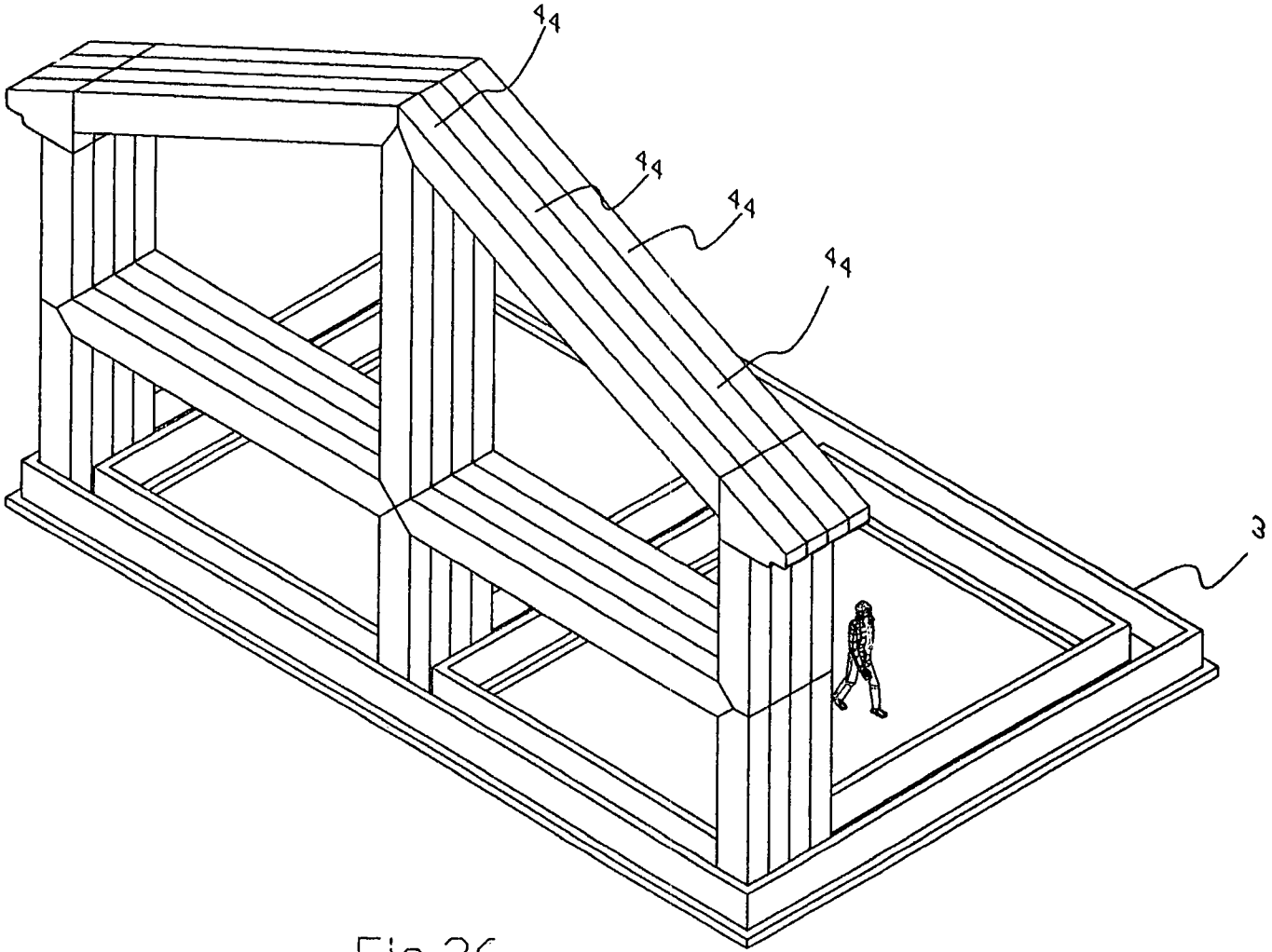
FIGS. 36 and 37 are perspective views of additional slices positioned on the footings.

FIG. 36 shows a perspective view of four slices 44 positioned on the footings 3. The two sets of joined slices 44 forming the four slices 44 are joined to each other on their abutting faces, the outside surfaces of the webs 49, by adhesives.

Figure 37:
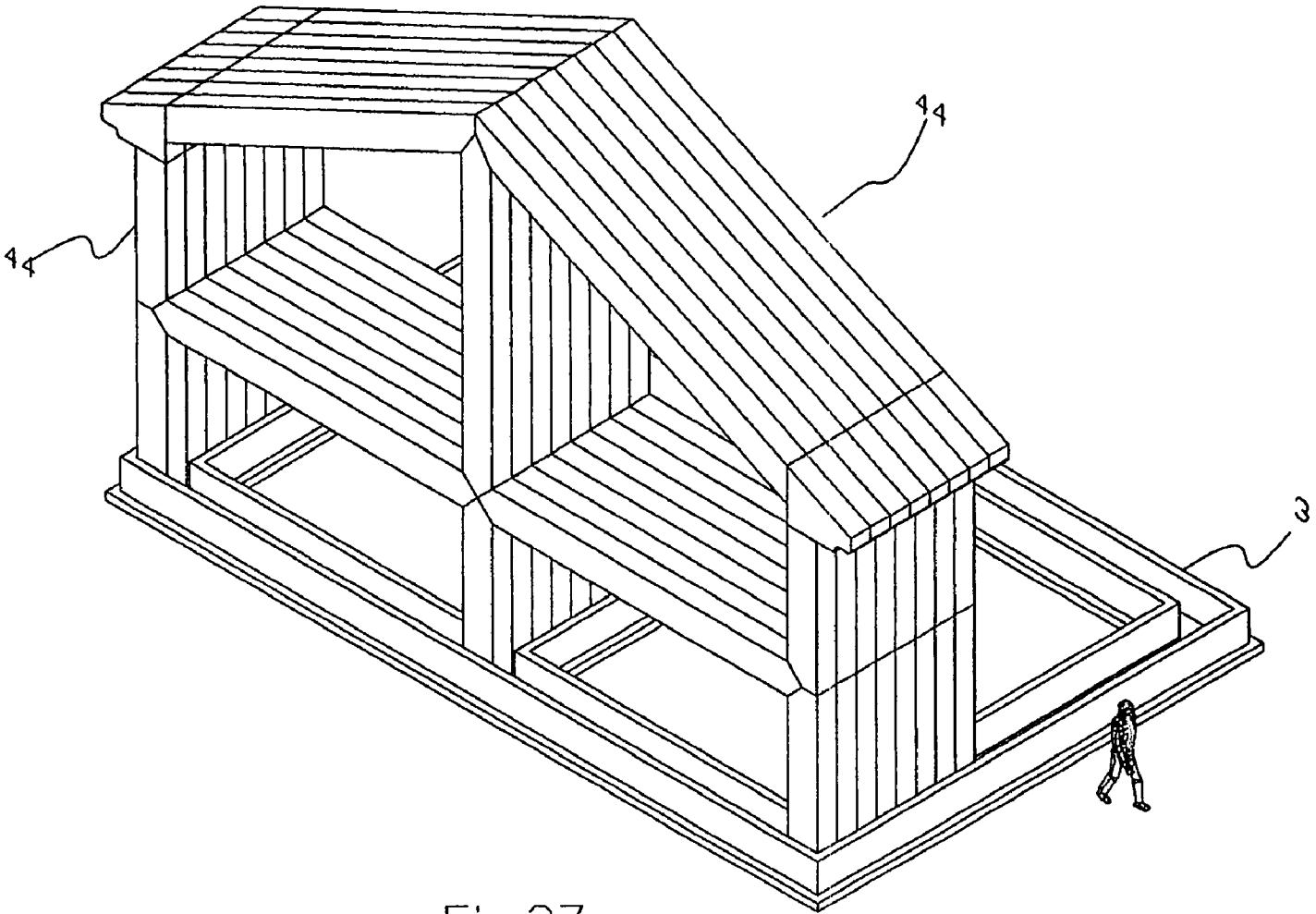

FIG. 37 shows eight slices 44 positioned on the footings 3. The bottoms of the slices 44 are usually adhered to the footings 3 by grout or other adhesive.

Figure 38:
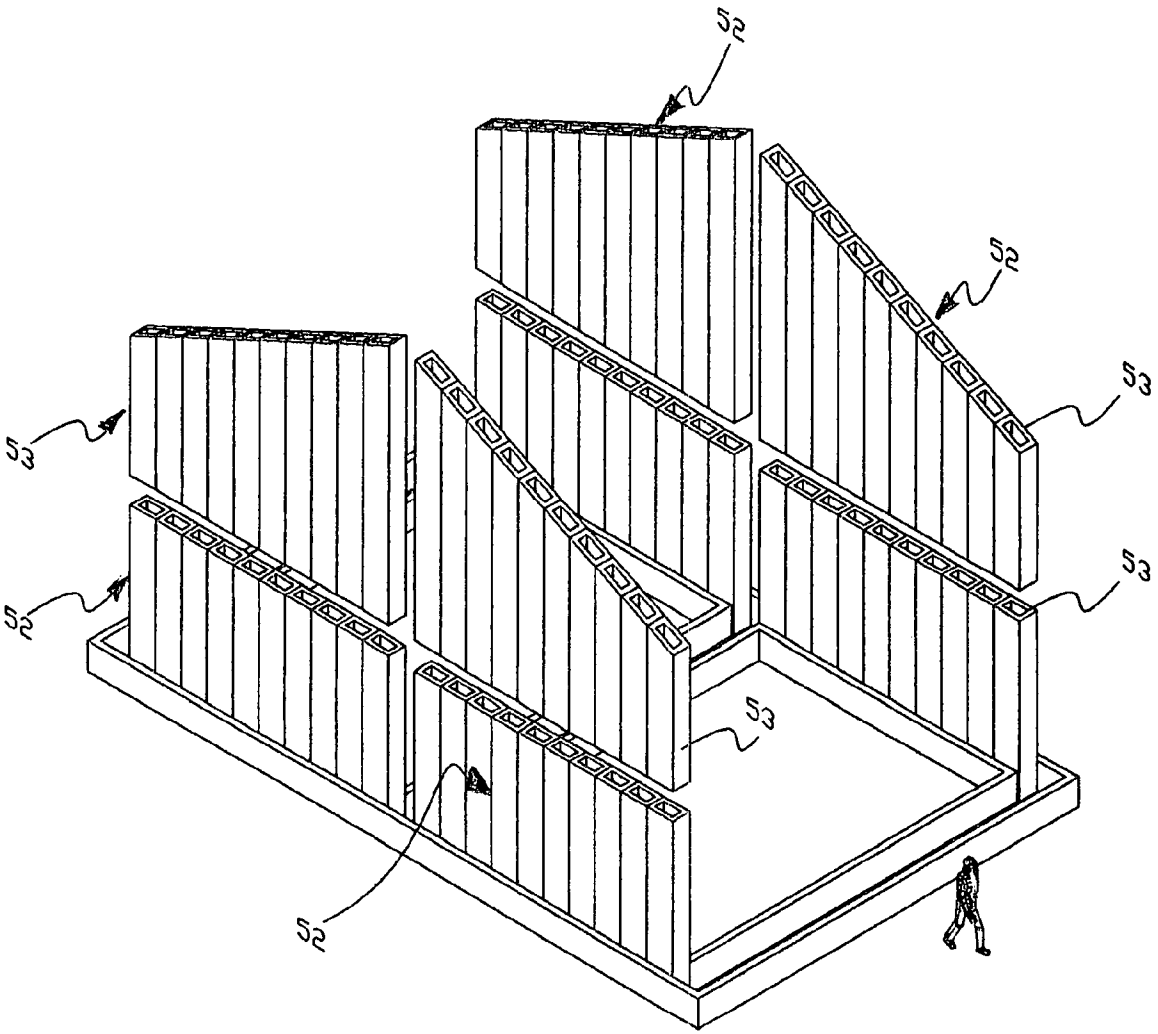
FIG. 38 is a perspective view of some of the pieces which make the end walls.
Figure 39:
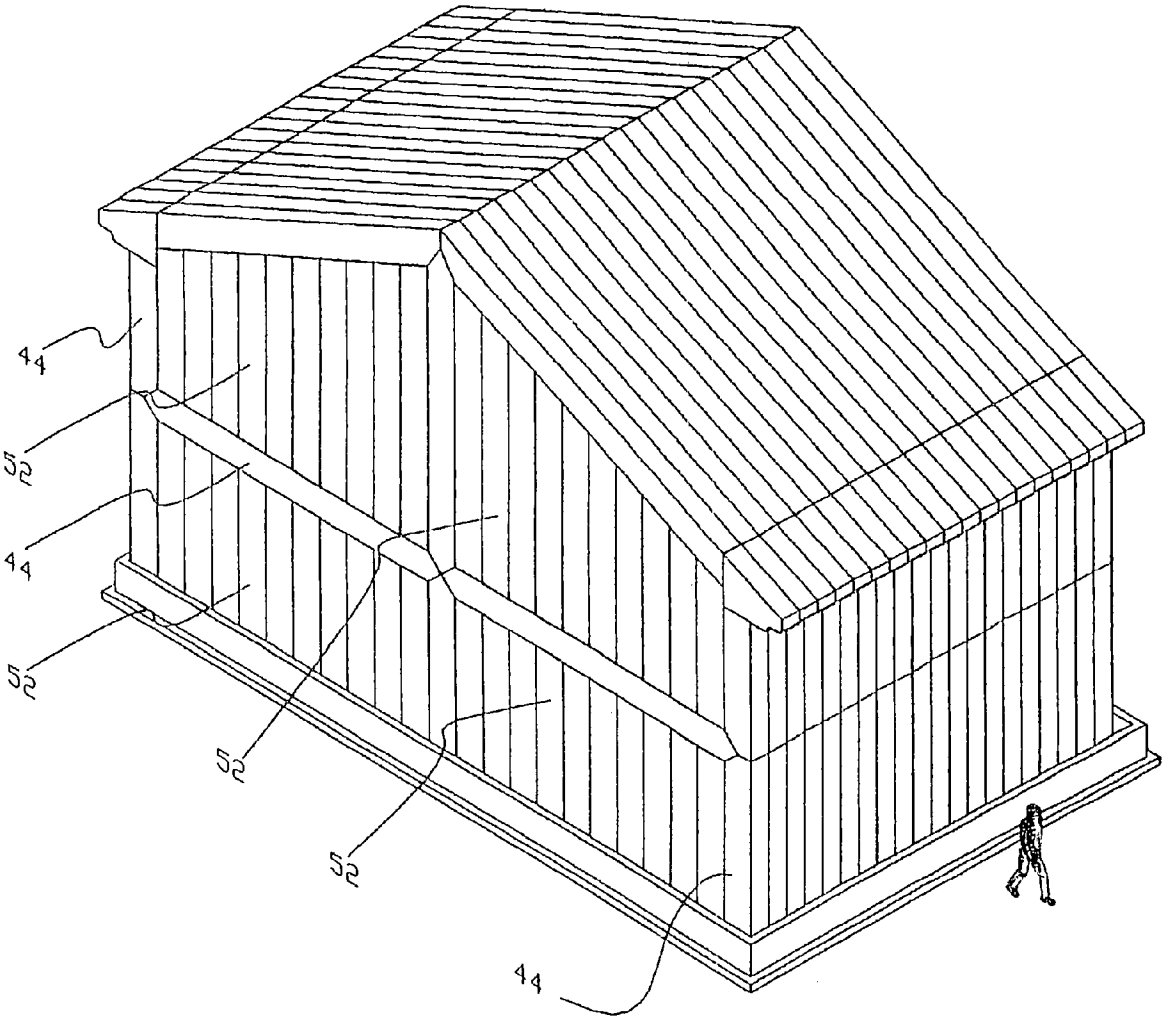
FIG. 39 is a perspective view showing the fully formed end wall.

FIG. 38 is a perspective view showing end walls 52 formed from tubes 53 having a rectangular cross-section. The tubes 53 can be formed from four foam pieces joined by adhesives. The some of the internal surfaces of the tubes 53 may be coated with GFRC where added strength is needed. The tubes 53 are adhered to adjacent tubes by adhesives. The end walls fill in the spaces in slices 44 as shown in FIG. 39.

Figure 40:
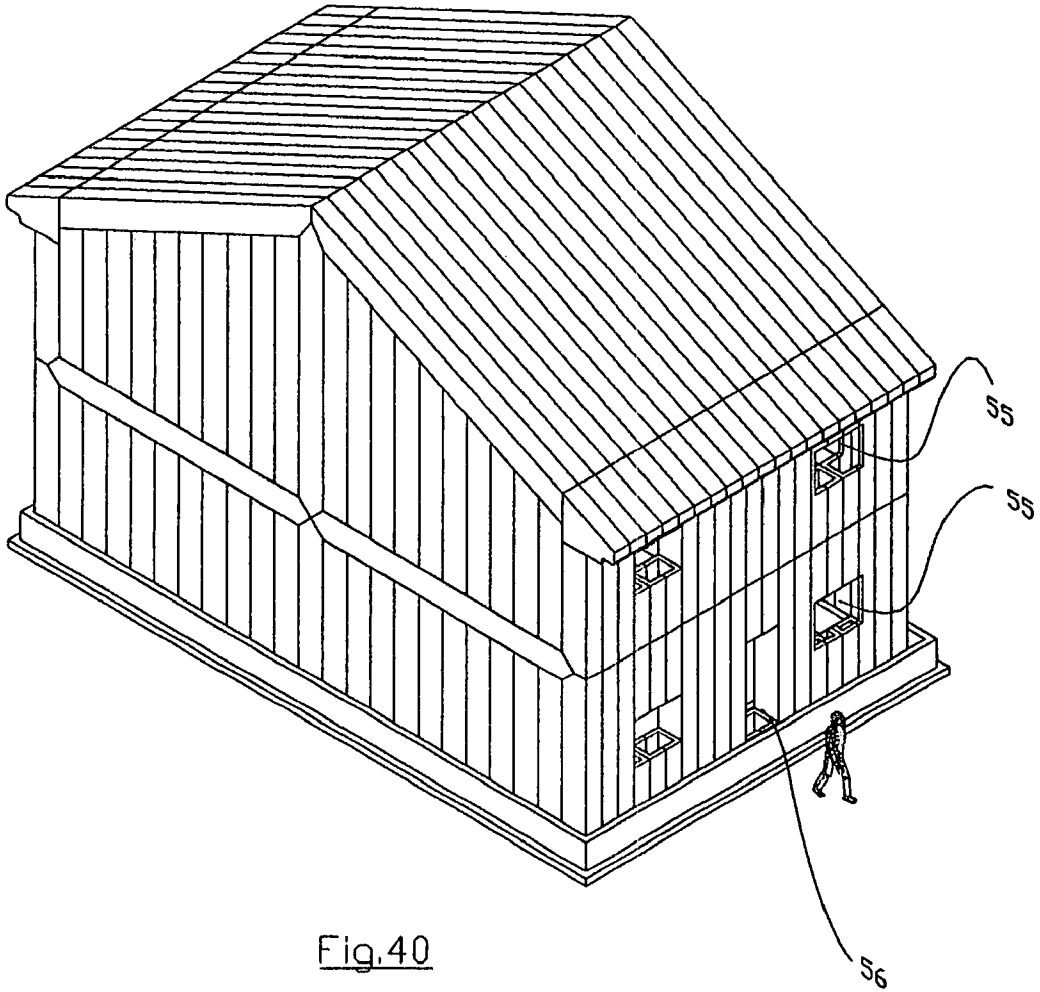
FIG. 40 is a perspective view of the assembled building.

FIG. 40 shows a perspective view of the assembled building 2 with the windows 55 and door 56 cut out.

Figure 41:
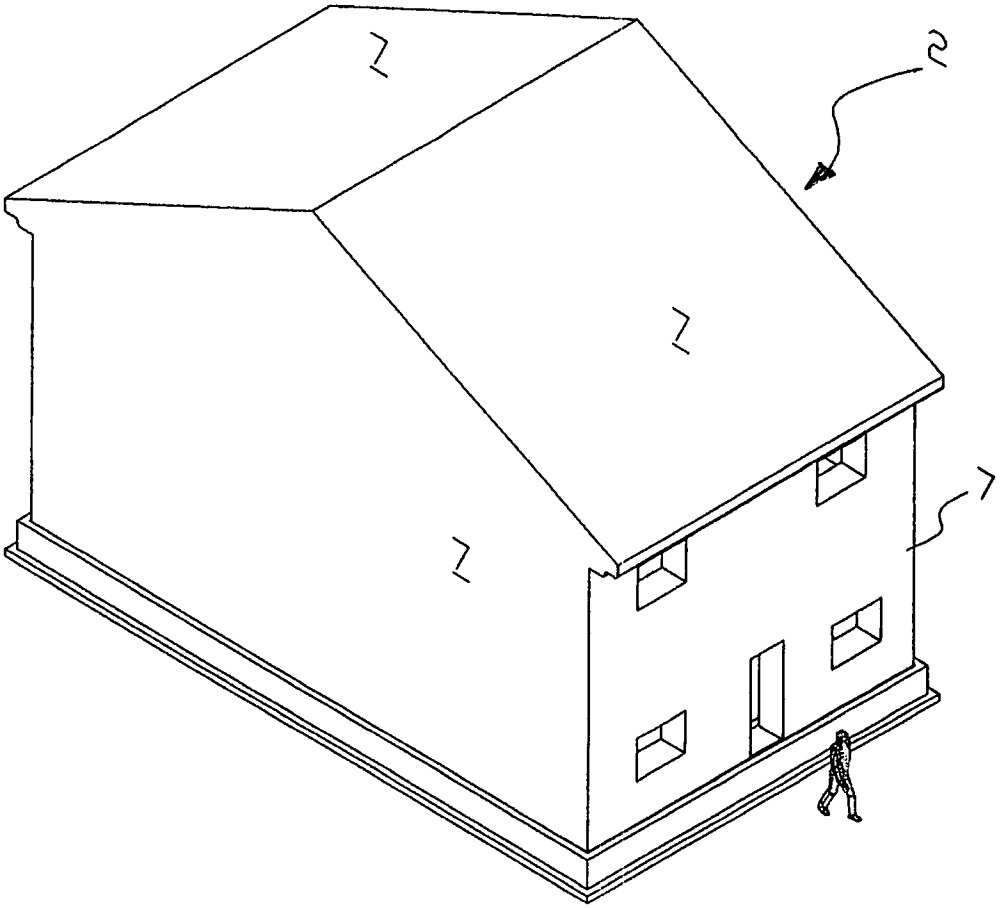
FIG. 41 is a perspective view of the building with the exterior coat of GFRC applied.

FIG. 41 shows a perspective view of the assembled building 2 with the exterior coated with GFRC coating 7. The interior surfaces are also coated with GFRC. The inner and outer GFRC coatings 7 form inner and outer shells on the foam composite building 2. The strength of the building is greatly increased by adding GFRC coatings to the inner surfaces of the slice 44. The inner coatings can be as little as 1/16 inches.

Figure 42:
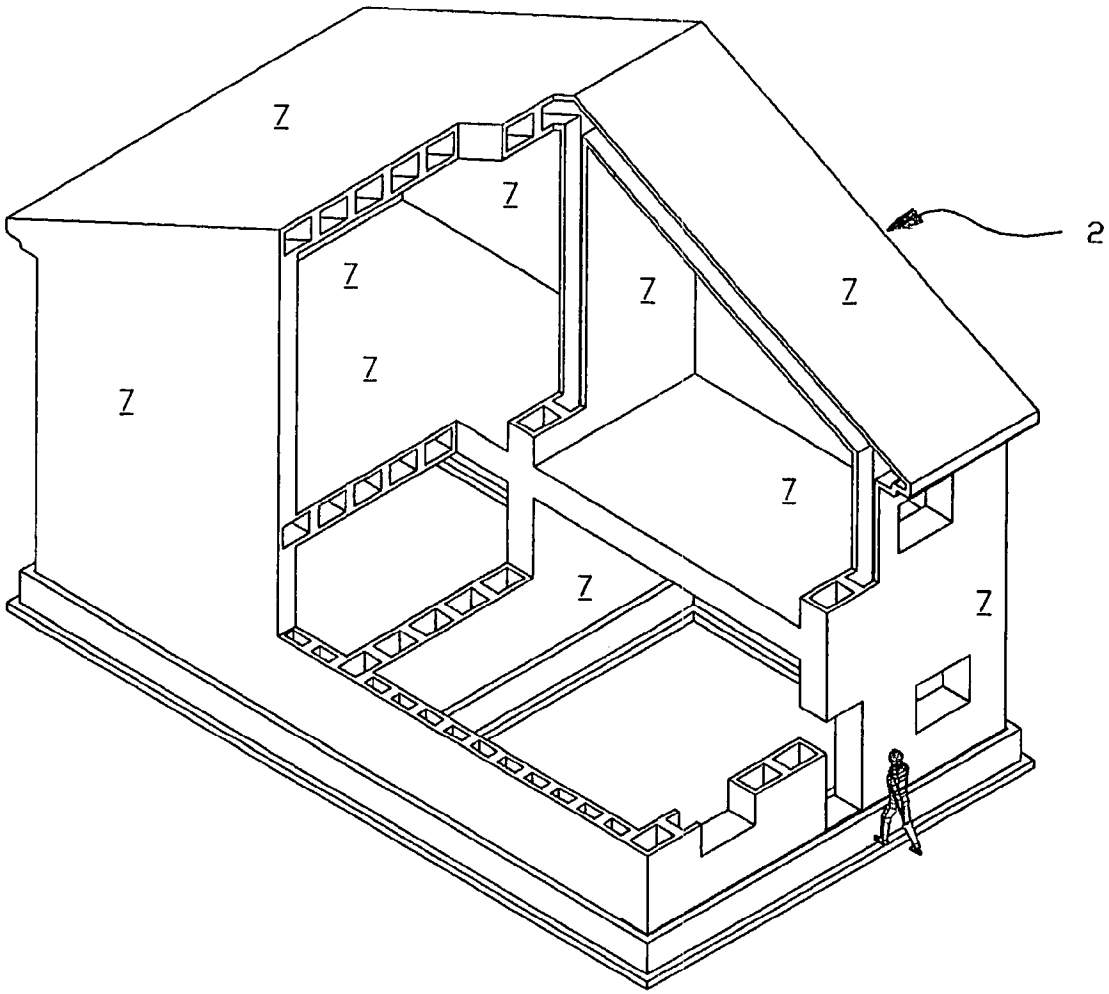
FIG. 42 is a perspective view of the building of FIG. 41 with portions removed.

FIG. 42 shows the building of FIG. 41 with some portions removed to show the insides of the building with interior GFRC coatings 7. The internal stairs and doorways have been omitted for simplicity.

Figure 43:
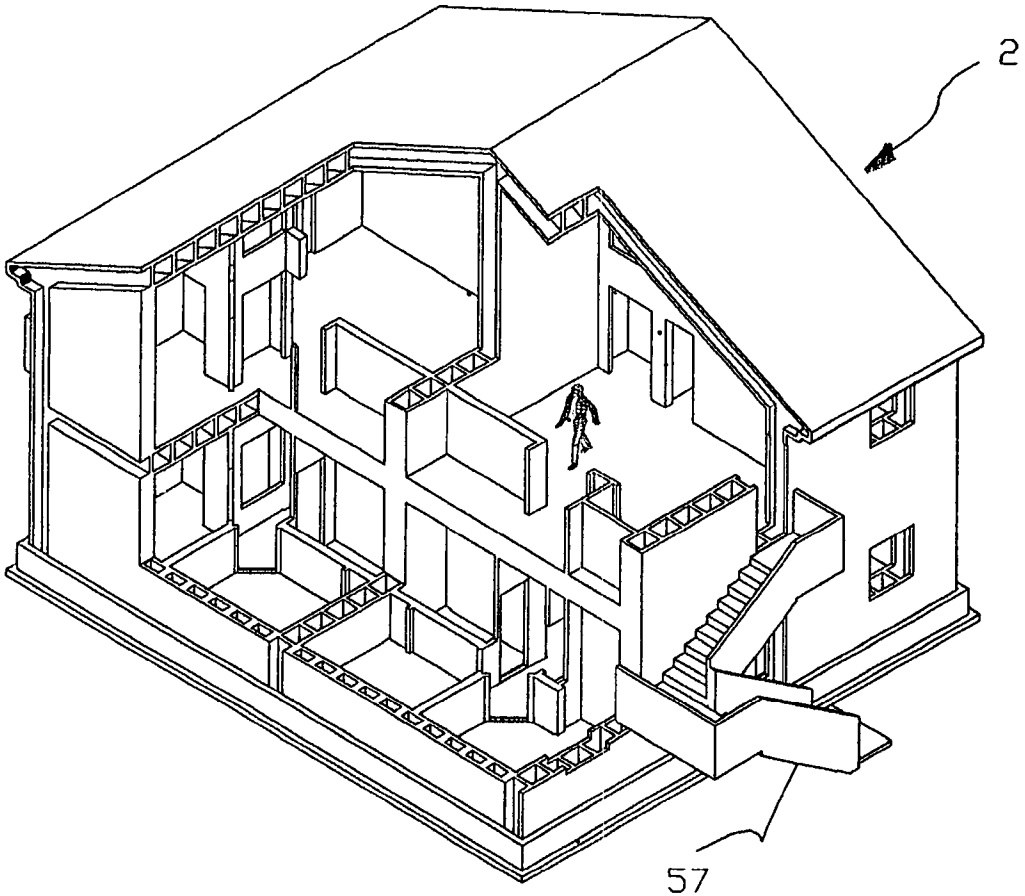
FIG. 43 is a perspective of a top and bottom duplex building with portions removed.

FIG. 43 shows a top and bottom duplex building 2 with the top floor duplex being accessed by use of stairs 57.

Figure 44:
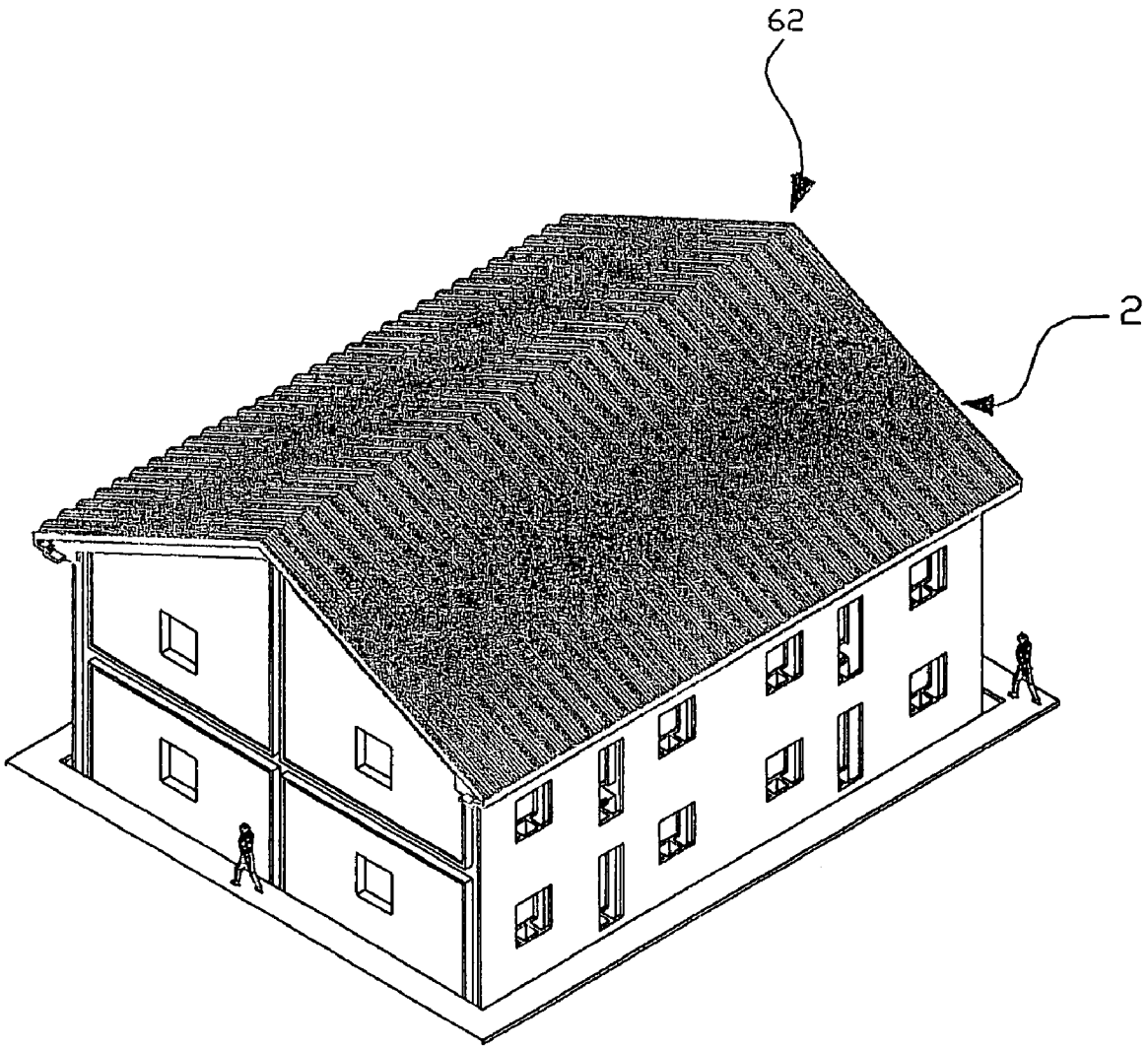
FIG. 44 is a perspective view of an eight unit building.

FIG. 44 shows an eight-unit building with the outer upper unit stairs omitted. There are four units front to back in this design. The roof 62 is formed by shaping the foam to mimic traditional roofing such as Spanish roofing tiles here.

There can be as many floors as desired built using the I or C-Beam technology of this invention.

Figure 45:
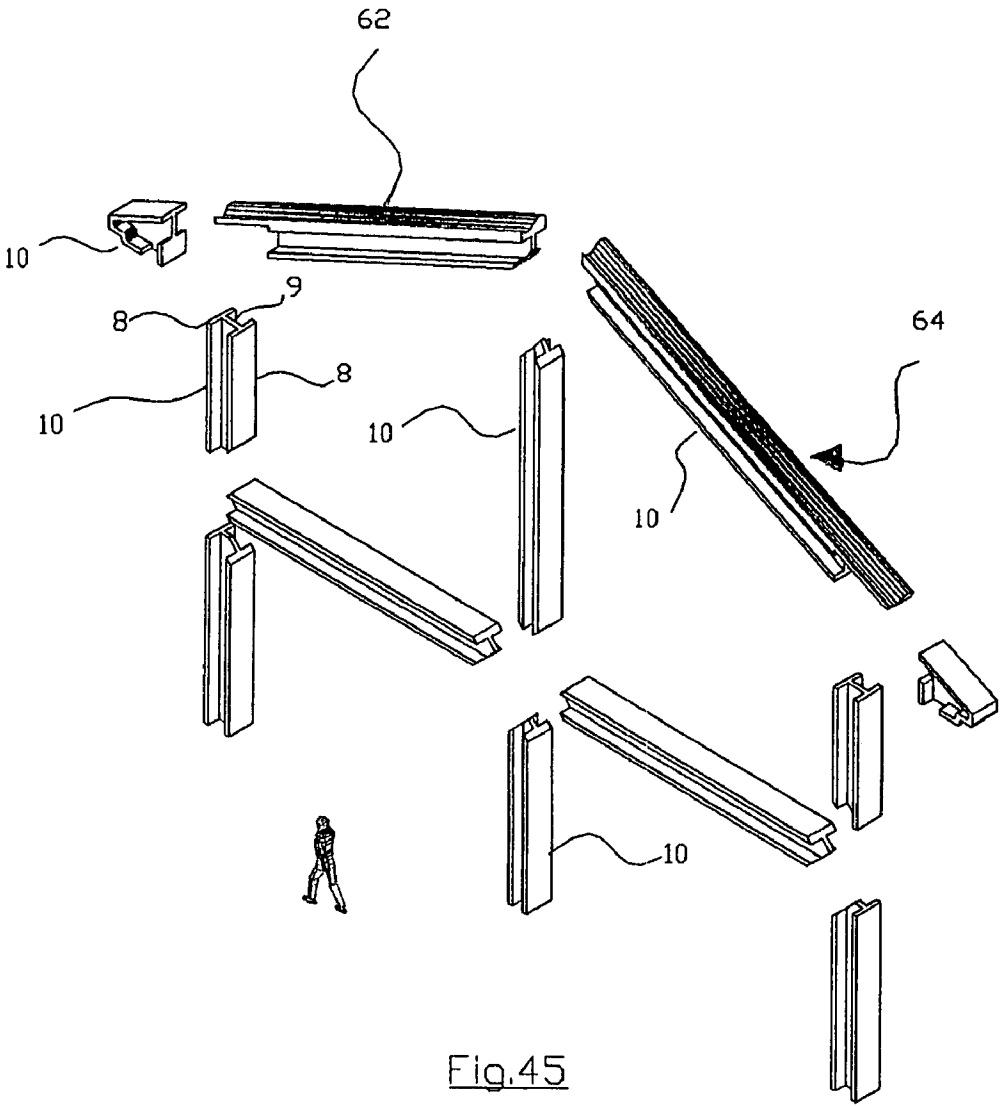
FIG. 45 is an exploded perspective view of a slice with a shaped roof.
Figure 46:
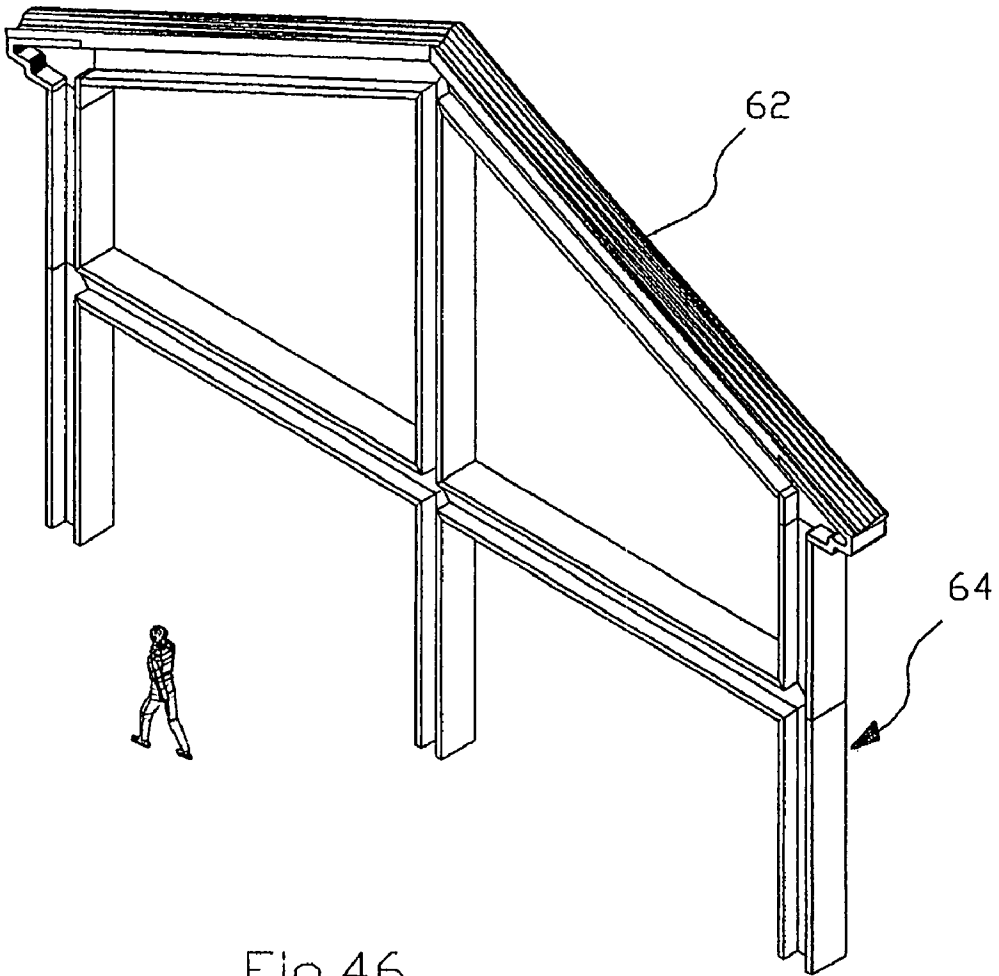
FIG. 46 is a perspective view of the assembled slice of FIG. 45.

FIGS. 45 and 46 show a full I-Beam slice 64 with a shaped roof 62. The I-Beam 10 has flanges 8 and web 9.

Figure 47:
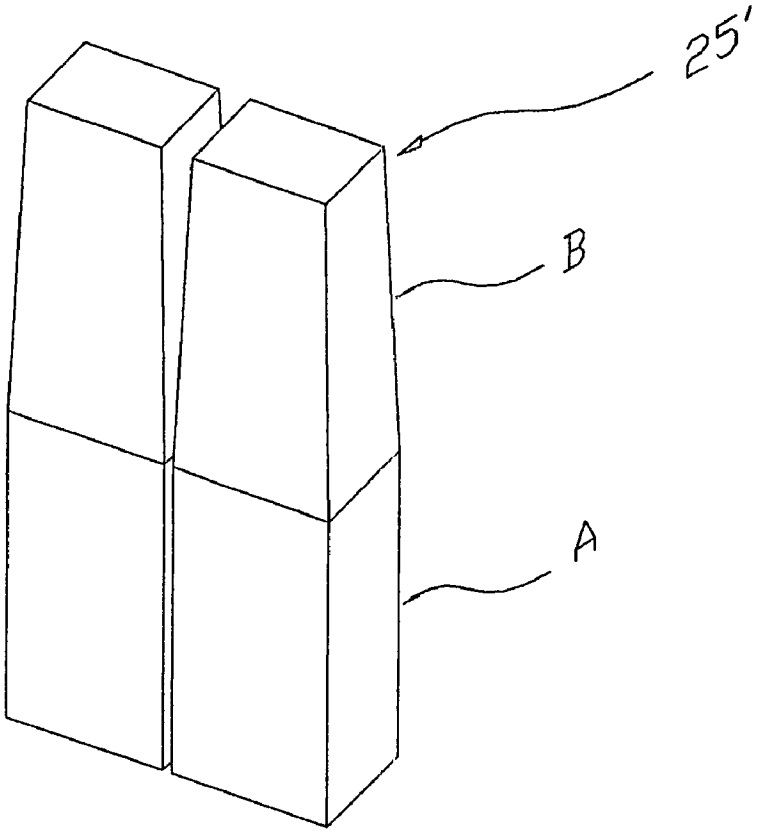
FIGS. 47 and 47A are perspective views of a modified dowel.
Figure 47A:
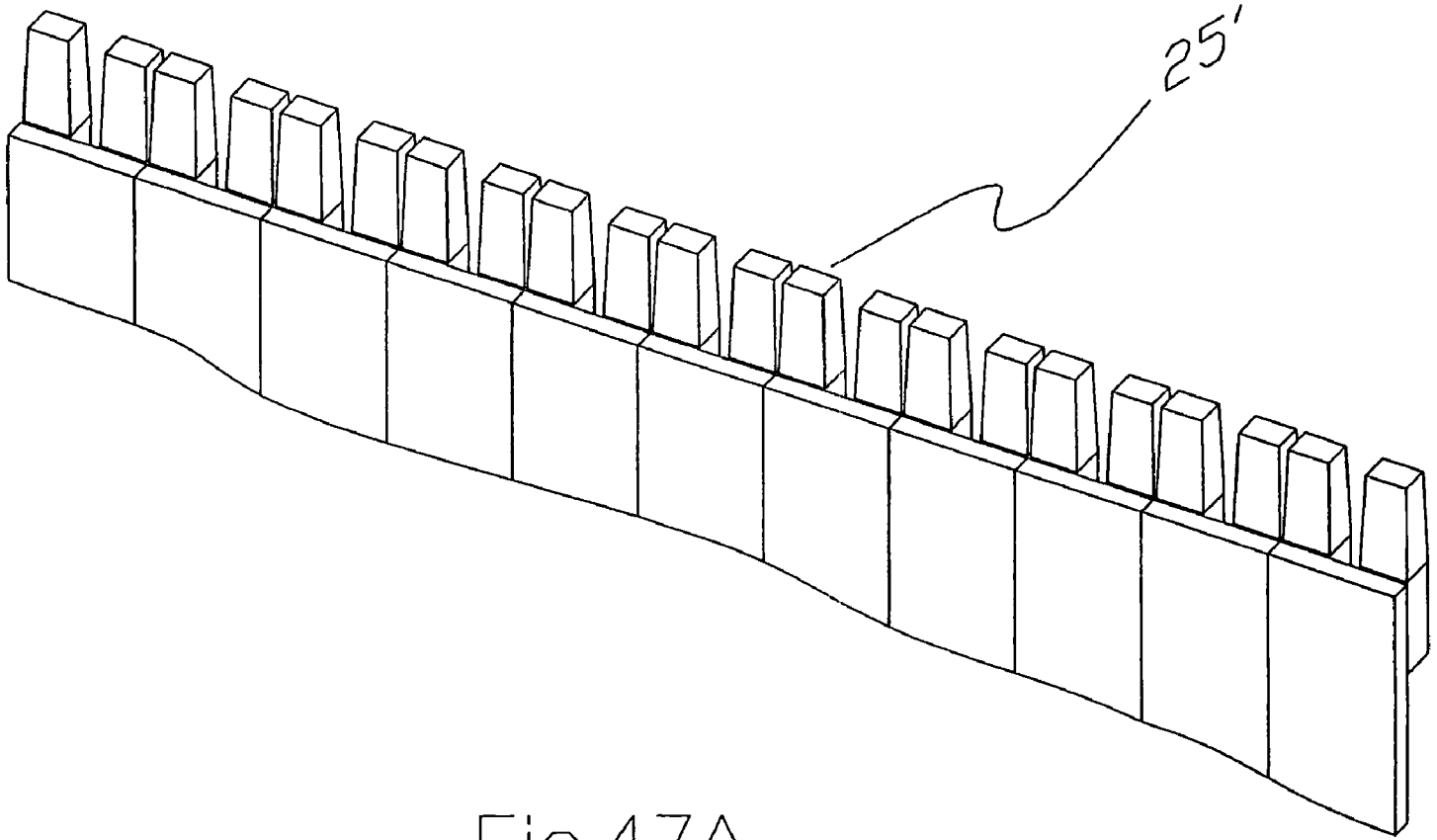

FIGS. 47, 47A show a modified dowel 25'. Dowel 25' has a bottom portion A that is not tapered and a top portion B that has a taper, such as a 2% taper. The dowel can be three feet long. FIG. 47A shows the dowels 25' in place.

Figure 48:
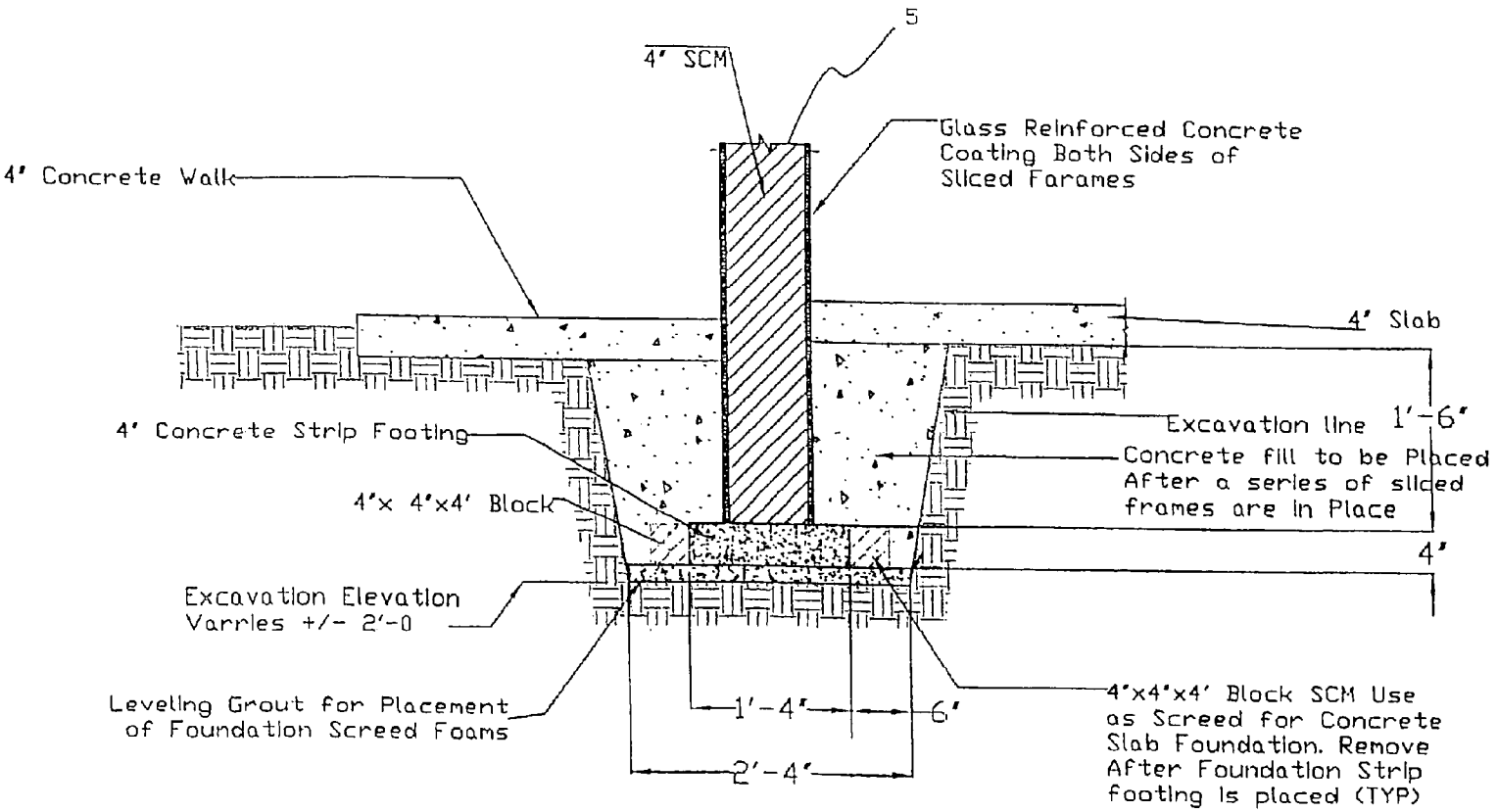
FIG. 48 is a cross-sectional view of a portion of a slice positioned on a footing.

FIG. 48 shows a cross-sectional view of a slice wall positioned on a footing in more detail. The four inches of SCM or foam 5 is usually four inches of EPS.

Figure 49:
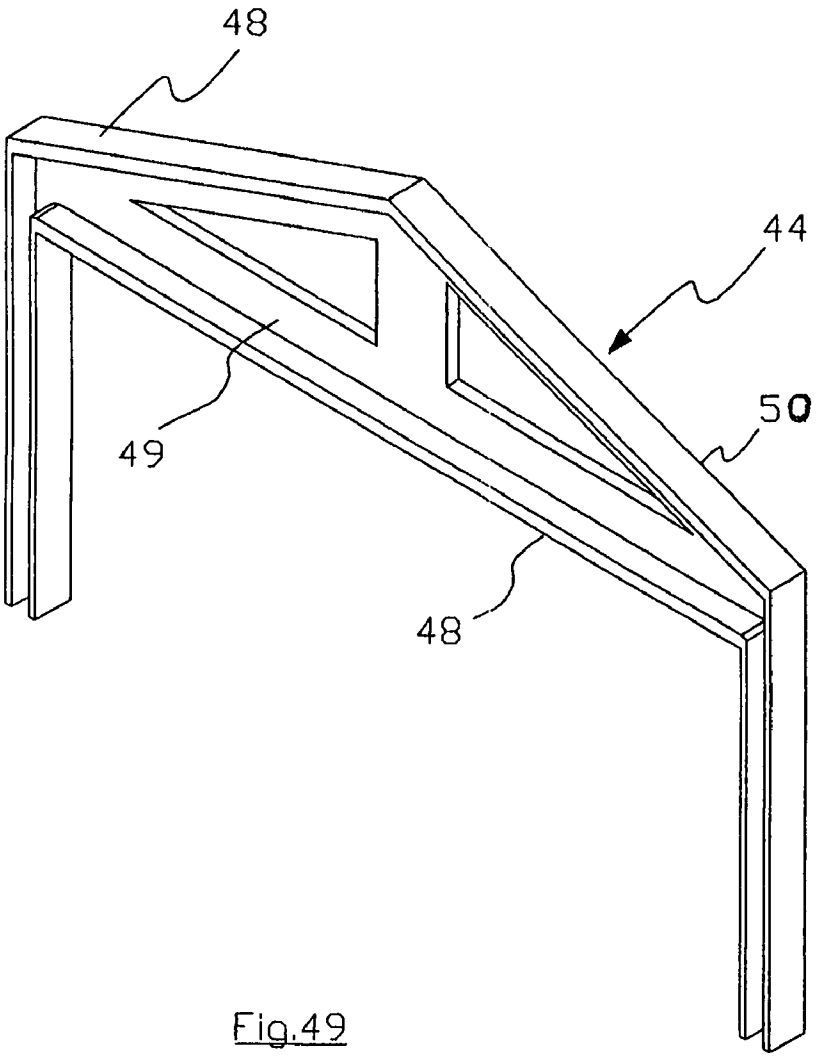
FIG. 49 is a perspective view of another embodiment of the C-Beam slice.

FIG. 49 shows a perspective view of another embodiment of the C-Beam 50 showing a full slice 44. In this embodiment, the web 49 is made larger and has portions that are omitted. The top angled portions of the web 49 form the rafters, the center portion forms the post and the bottom portion forms the ceiling joist of a roof. The top flange 48 of the beam can form the roof sheathing or a portion of the roof. The bottom flange 48 of the beam can form the ceiling or a portion of the ceiling. The C-beam could be an I-beam (FIG. 5) or other beam cross-sectional configuration. The web and/or the flange can be coated a fiber reinforced coating before installation to provide strength to the beams. This configuration is very strong once it is joined to other slices.

The top flange 48 can be shaped to mimic traditional roofing, such as Spanish roofing tiles, by shaping the foam in that pattern as shown in FIGS. 44-46. A fiber reinforced coating can be provided to form the exterior portion of a roof. Alternatively, roofing shingles or tiles can be added to form a conventional roof. Alternatively, additional sheathing can be added, and the shingles and tiles added to the sheathing.

Figure 50:
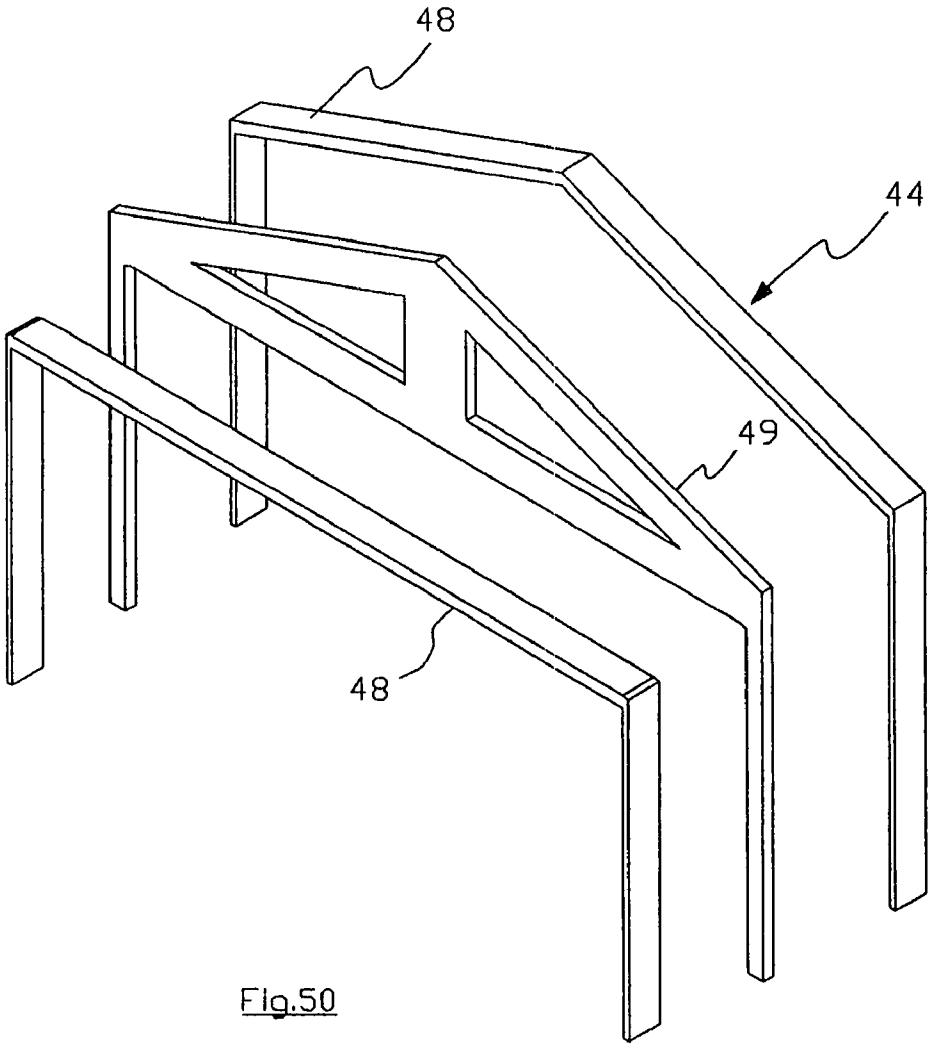
FIG. 50 is an exploded perspective view of the slice.

FIG. 50 shows an exploded perspective view of the foam pieces making up the C-Beam full slice 44.

Figure 51:
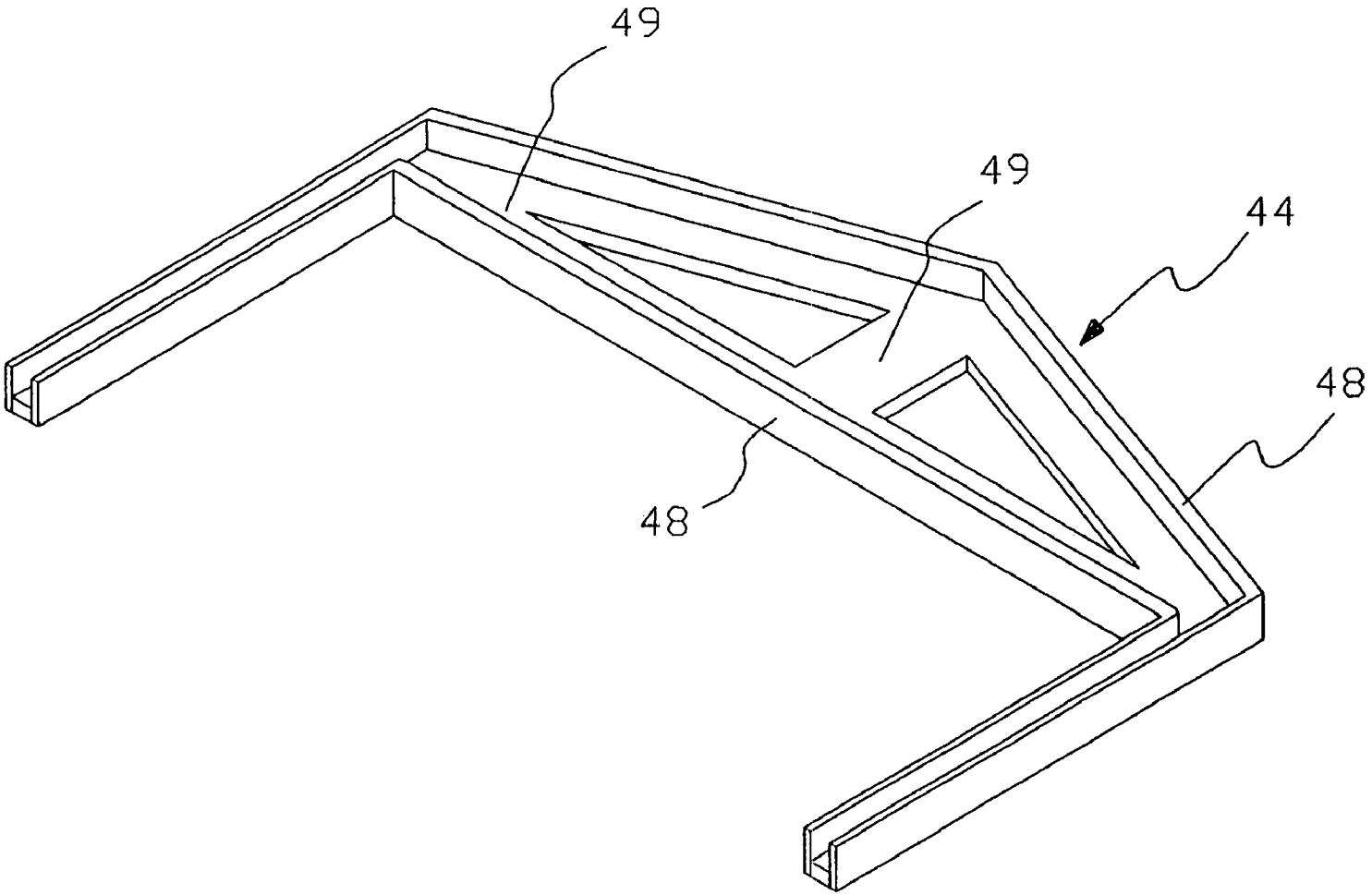
FIG. 51 is a perspective view of the slice in the horizontal plane after assembly.

FIG. 51 shows a perspective view of the assembled C-Beam full slice 44 of FIG. 49 horizontally positioned.

Because the building is solely built from a composite material, foam coated on both sides with reinforced concrete (GFRC), it is possible to analyze the structure accurately. Because of the accuracy of the analysis of the inventive building, it is possible to reduce the amount of material needed to meet the predicted loading of the building. Further, because this building is constructed of inner and outer shells with foam therebetween, it is a very strong structure for its mass. Conversely, stick built buildings have a vast array of elements which make them very difficult to impossible to analyze. Therefore, to meet their loading requirements they have to be over designed. Further, their angles create high stresses at their joints during loading.

The composite building material formed from GFRC coated foam has many advantages. The plastic foam has a very high heat insulation value. The foam thickness can be increased easily to increase the thermal insulation value of the composite. The GFRC coating is highly resistant to vapor and moisture penetration as also is the EPS foam core. The strength of the composite is greatly increased by the foam core since the strength is a function of the thickness of the foam core. The foam core acts as a moment arm between the coatings on its opposite sides. Thus, increasing the thickness of the foam increases the insulation value and the strength of the composite. The composite building material can be used to create flat walls since the composite exhibits enough strength to be used in that design. The composite material can be used to create a building without curved ceilings.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

I claim:

1. A method of constructing a portion of a building roof formed from a composite material, the composite material being formed from a selected plastic foam coated on at least one surface with a fiber reinforced coating, the roof having a surface interior to and a surface exterior to the building, the method comprising the following steps, the roof being constructed from beams, each beam having top and bottom flanges and a web therebetween, the flanges having top and bottom surfaces and the web having opposing surfaces, the flanges and the web having opposing edge surfaces, coating the bottom surface of the top flange, the top surface of the bottom flange and the opposing surfaces of the web of the beam with a fiber reinforced coating, joining the beams together at abutting uncoated edge surfaces of the flanges and the web to form a portion of the roof and coating the roof surface interior to and exterior to the building roof formed from the joined beams with a fiber reinforced coating.

2. The method of claim 1 wherein, the flanges of the beam form portions of the roof and ceiling.

3. The method of claim 1 wherein, the beam forms a rafter, a post and a ceiling joist of the roof.

4. The method of claim 1 wherein, the bottom beam flanges are angled to form an angled ceiling.

5. The method of claim 1 wherein, the bottom beam flanges are horizontal to form a flat ceiling.

6. The method of claim 1 wherein, the top flange is shaped to mimic the look of a shingled roof.

7. The method of claim 1 wherein, the top flange is shaped to mimic the look of a tiled roof.

8. The method of claim 1 including the step of, coating the top surface of the top flange and the bottom surface of the bottom flange of the beams with a fiber reinforced coating before joining the beams together.

* * * * *